US009937725B1

(12) United States Patent
Komplin

(10) Patent No.: US 9,937,725 B1
(45) Date of Patent: Apr. 10, 2018

(54) FLUIDIC DISPENSING DEVICE

(71) Applicant: FUNAI ELECTRIC CO., LTD., Osaka (JP)

(72) Inventor: Steven R. Komplin, Lexington, KY (US)

(73) Assignee: FUNAI ELECTRIC CO., LTD. (JP)

( * ) Notice: Subject to any disclaimer, the term of this patent is extended or adjusted under 35 U.S.C. 154(b) by 0 days.

(21) Appl. No.: 15/435,983

(22) Filed: Feb. 17, 2017

(51) Int. Cl.
*B41J 2/19* (2006.01)

(52) U.S. Cl.
CPC ..... *B41J 2/19* (2013.01)

(58) Field of Classification Search
None
See application file for complete search history.

(56) References Cited

U.S. PATENT DOCUMENTS

| | | | |
|---|---|---|---|
| 5,198,156 | A | 3/1993 | Middleton et al. |
| 6,332,676 | B1 | 12/2001 | Santhanam |
| 6,362,859 | B1 | 3/2002 | Hagiwara et al. |
| 6,969,164 | B2 | 11/2005 | Kerr et al. |
| 7,172,272 | B2 | 2/2007 | Tsuchiya et al. |
| 7,182,444 | B2 | 2/2007 | Kawamoto |
| 7,618,133 | B2 | 11/2009 | Kubo et al. |
| 7,894,023 | B2 | 2/2011 | Ando et al. |
| 8,608,300 | B2 | 12/2013 | Igawa et al. |
| 2001/0013886 | A1 | 8/2001 | Underwood et al. |
| 2001/0015742 | A1 | 8/2001 | Childers |
| 2001/0024225 | A1 | 9/2001 | Ishizawa et al. |
| 2001/0030675 | A1 | 10/2001 | Kobayashi et al. |
| 2002/0012026 | A1 | 1/2002 | Kubota et al. |
| 2002/0089576 | A1 | 7/2002 | Ishizawa et al. |
| 2002/0109760 | A1 | 8/2002 | Miyazawa et al. |
| 2002/0154570 | A1 | 10/2002 | Gebrian |
| 2002/0167555 | A1 | 11/2002 | Miura et al. |
| 2003/0042274 | A1 | 3/2003 | Johanson |
| 2003/0072216 | A1 | 4/2003 | Araki |
| 2003/0107950 | A1 | 6/2003 | Shepherd et al. |
| 2004/0051766 | A1 | 3/2004 | Miyazawa et al. |
| 2004/0095842 | A1 | 5/2004 | Weetman |
| 2004/0104984 | A1 | 6/2004 | Hall et al. |
| 2005/0046682 | A1 | 3/2005 | Kawamoto |
| 2005/0093211 | A1 | 5/2005 | Shiraishi et al. |
| 2005/0248634 | A1 | 11/2005 | Aruga |
| 2006/0071989 | A1 | 4/2006 | Lewey et al. |
| 2006/0268080 | A1 | 11/2006 | Nakazawa |
| 2006/0290753 | A1 | 12/2006 | Tatsumi et al. |
| 2007/0019047 | A1 | 1/2007 | Kleinert et al. |
| 2007/0052771 | A1 | 3/2007 | Inoue et al. |
| 2007/0052773 | A1 | 3/2007 | Kawamura et al. |
| 2007/0165485 | A1 | 7/2007 | Cai |

(Continued)

FOREIGN PATENT DOCUMENTS

WO WO 201417418 A2 * 10/2014 ..... B05B 11/0018

OTHER PUBLICATIONS

IP.com search.*

*Primary Examiner* — Lisa M Solomon
(74) *Attorney, Agent, or Firm* — Aust IP Law

(57) ABSTRACT

A fluidic dispensing device includes a casing having a reservoir chamber and a primary vent chamber. An end cap is positioned at an end of the casing. The end cap is connected to the casing. A vent path extends from the primary vent chamber to the atmosphere through a gap between the end cap and the casing.

20 Claims, 14 Drawing Sheets

(56) References Cited

U.S. PATENT DOCUMENTS

| | | | |
|---|---|---|---|
| 2007/0188563 | A1 | 8/2007 | Takahashi |
| 2007/0242114 | A1 | 10/2007 | Kubota et al. |
| 2008/0031088 | A1 | 2/2008 | Ukita |
| 2008/0165233 | A1 | 7/2008 | Lin et al. |
| 2008/0186368 | A1 | 8/2008 | Silverbrook et al. |
| 2009/0033725 | A1 | 2/2009 | Toba et al. |
| 2009/0079802 | A1 | 3/2009 | Ito |
| 2009/0122121 | A1 | 5/2009 | Kawasaki et al. |
| 2009/0189931 | A1 | 7/2009 | Noro et al. |
| 2009/0213159 | A1 | 8/2009 | Aoki et al. |
| 2009/0251517 | A1 | 10/2009 | Matsumoto |
| 2009/0289976 | A1 | 11/2009 | Nishimura |
| 2009/0322840 | A1 | 12/2009 | Wanibe |
| 2010/0103233 | A1 | 4/2010 | Akatsuka et al. |
| 2011/0280098 | A1 | 11/2011 | Shiono |
| 2012/0000645 | A1 | 1/2012 | Willimczik |
| 2012/0056948 | A1 | 3/2012 | Kim et al. |
| 2012/0062523 | A1 | 3/2012 | Park et al. |
| 2012/0075364 | A1 | 3/2012 | Nakazawa |
| 2012/0105555 | A1 | 5/2012 | McFarland et al. |
| 2012/0140003 | A1 | 6/2012 | Szusdziara et al. |
| 2012/0200645 | A1 | 8/2012 | Okina |
| 2012/0200649 | A1 | 8/2012 | Igawa et al. |
| 2013/0063523 | A1 | 3/2013 | Otaka et al. |
| 2013/0342618 | A1 | 12/2013 | Frasure et al. |
| 2014/0061961 | A1 | 3/2014 | Ishizawa et al. |
| 2014/0098146 | A1 | 4/2014 | Kamiyama |
| 2015/0165399 | A1 | 6/2015 | Rawlings |

* cited by examiner

FLUIDIC DISPENSING DEVICE

CROSS-REFERENCE TO RELATED APPLICATIONS

This application is related to U.S. patent application Ser. Nos. 15/183,666; 15/183,693; 15/183,705; 15/183,722; 15/183,736; 15/193,476; 15/216,104; 15/239,113; 15/256,065; 15/278,369; 15/373,123; 15/373,243; 15/373,635; and Ser. No. 15/373,684.

BACKGROUND OF THE INVENTION

1. Field of the Invention

The present invention relates to fluidic dispensing devices, and, more particularly, to a fluidic dispensing device, such as a microfluidic dispensing device, having a backpressure regulation member to control backpressure.

2. Description of the Related Art

One type of microfluidic dispensing device, such as an ink jet printhead, is designed to include a capillary member, such as foam or felt, to control backpressure. In this type of printhead, the only free fluid is present between a filter and the ejection device.

Another type of printhead is referred to in the art as a free fluid style printhead, which has a movable wall that is spring loaded to maintain backpressure at the nozzles of the printhead. One type of spring loaded movable wall uses a deformable deflection bladder to create the spring and wall in a single piece. An early printhead design by Hewlett-Packard Company used a circular/cylindrical deformable rubber part in the form of a thimble shaped bladder positioned between a container lid and a body. The thimble shaped bladder maintained backpressure in the ink enclosure defined by the thimble shaped bladder by deforming the bladder material as ink was delivered to the printhead chip. The deformation of the thimble shaped bladder collapses on itself, i.e., around and inwardly toward a central longitudinal axis.

In order to maintain backpressure in the printhead, the backside of the pressure regulating member, opposite to the fluid side, is vented to the atmosphere through a vent hole.

What is needed in the art is a fluidic dispensing device having an improved venting arrangement, which may increase options in placing external indicia or components, such as product labeling, on the device.

SUMMARY OF THE INVENTION

The present invention provides a fluidic dispensing device having an improved venting arrangement, which may increase options in placing external indicia or components, such as product labeling, on the device.

The invention in one form is directed to a fluidic dispensing device that includes a casing having a reservoir chamber and a primary vent chamber. An end cap is positioned at an end of the casing. The end cap is connected to the casing. A vent path extends from the primary vent chamber to the atmosphere through a gap between the end cap and the casing.

The invention in another form is directed to a fluidic dispensing device that includes a body having a reservoir chamber. An ejection chip is attached to the body in fluid communication with the reservoir chamber. A regulation member is associated with the reservoir chamber. A lid covers the reservoir chamber and is attached to the body. A vent path includes a vent path portion that extends through a gap between the lid and the body. The vent path is in fluid communication both with the regulation member and with the atmosphere external to the fluidic dispensing device.

The invention in another form is directed to a fluidic dispensing device that includes a body having an exterior perimeter wall and a reservoir chamber located within a boundary defined by the exterior perimeter wall. The reservoir chamber has a perimetrical end surface. An ejection chip is mounted to the exterior wall. The ejection chip is in fluid communication with the reservoir chamber. A diaphragm is positioned in sealing engagement with the perimetrical end surface of the reservoir chamber. The diaphragm has a dome portion, wherein the dome portion moves along a deflection axis as the fluid is depleted from the fluid reservoir. A lid is engaged with the exterior perimeter wall and is attached to the body. The lid is positioned to cover the diaphragm to form a dome vent chamber between the lid and the diaphragm. An end cap is positioned on an end of the body and lid opposite to the ejection chip. A secondary vent chamber is located between the end cap and at least one of the body and the lid. A vent path extends from the dome vent chamber through the secondary vent chamber to the atmosphere.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
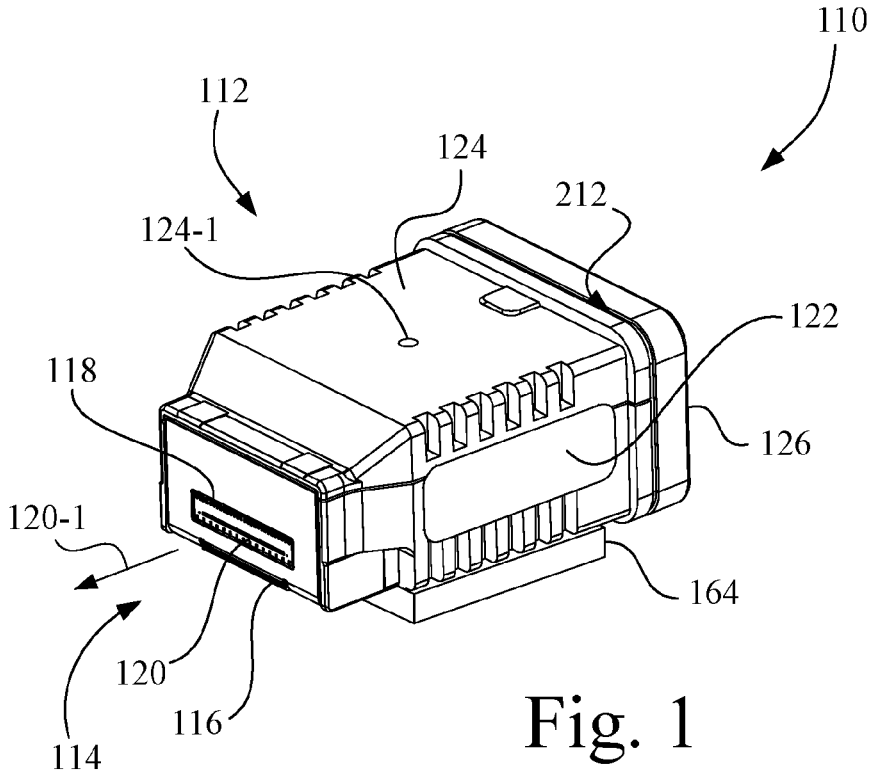
FIG. 1 is a perspective view of a microfluidic dispensing device in accordance with an embodiment of the present invention, in an environment that includes an external magnetic field generator.
Figure 2:
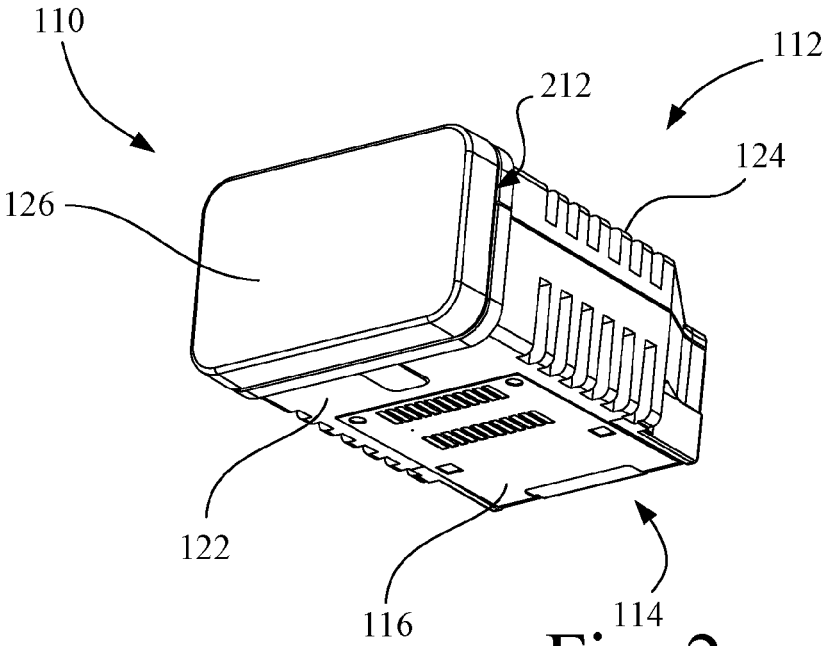
FIG. 2 is another perspective view of the microfluidic dispensing device of FIG. 1.

Referring now to the drawings, and more particularly to FIGS. 1-16, there is shown a fluidic dispensing device, which in the present example is a microfluidic dispensing device 110 in accordance with an embodiment of the present invention.

Referring to FIGS. 1-5, microfluidic dispensing device 110 generally includes a housing 112 and a tape automated bonding (TAB) circuit 114. Microfluidic dispensing device 110 is configured to contain a supply of a fluid, such as a fluid containing particulate material, and TAB circuit 114 is configured to facilitate the ejection of the fluid from housing 112. The fluid may be, for example, cosmetics, lubricants, paint, ink, etc.

Figure 6:
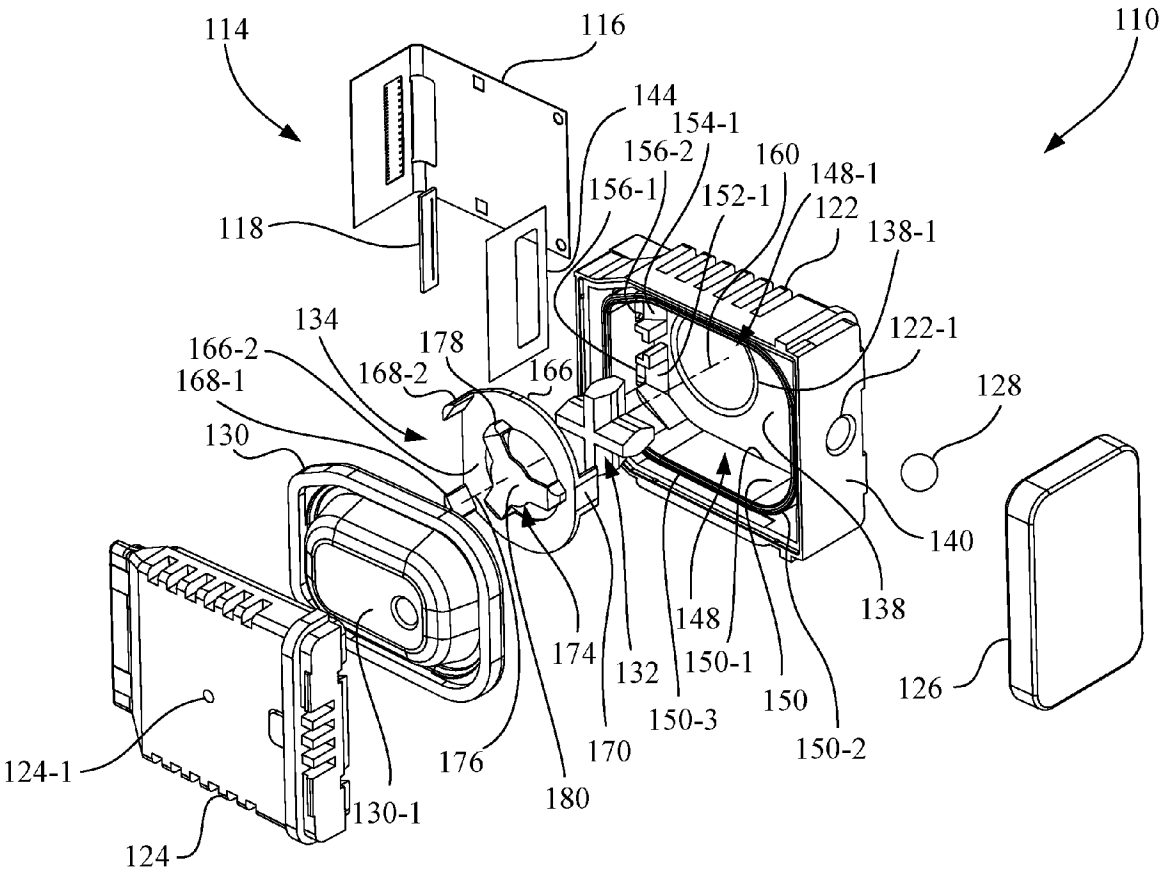
FIG. 6 is an exploded perspective view of the microfluidic dispensing device of FIGS. 1 and 2, oriented for viewing into the chamber of the body in a direction toward the ejection chip.
Figure 7:
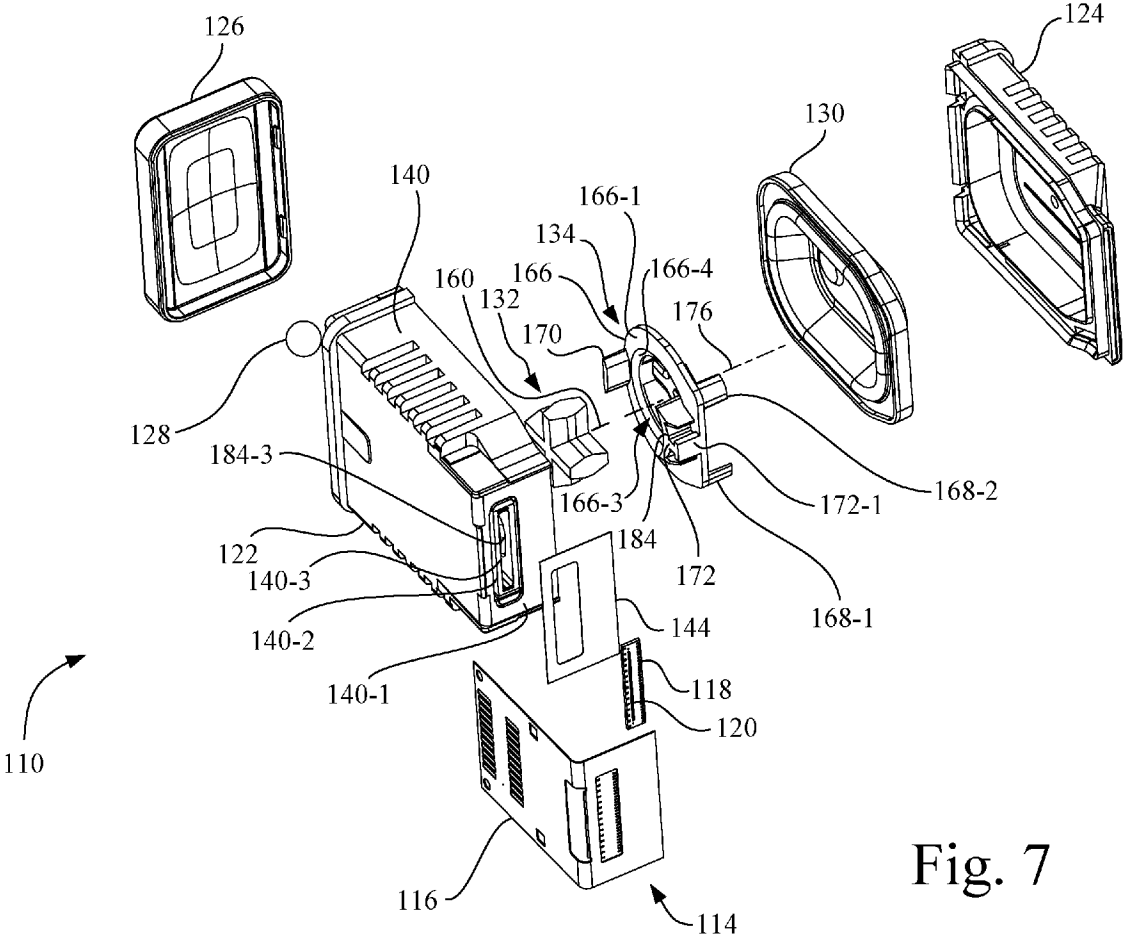
FIG. 7 is another exploded perspective view of the microfluidic dispensing device of FIGS. 1 and 2, oriented for viewing in a direction away from the ejection chip.

Referring also to FIGS. 6 and 7, TAB circuit 114 includes a flex circuit 116 to which an ejection chip 118 is mechanically and electrically connected. Flex circuit 116 provides electrical connection to an electrical driver device (not shown), such as an ink jet printer, configured to operate ejection chip 118 to eject the fluid that is contained within housing 112. In the present embodiment, ejection chip 118 is configured as a plate-like structure having a planar extent formed generally as a nozzle plate layer and a silicon layer, as is well known in the art. The nozzle plate layer of ejection chip 118 has a plurality of ejection nozzles 120 oriented such that a fluid ejection direction 120-1 is substantially orthogonal to the planar extent of ejection chip 118. Associated with each of the ejection nozzles 120, at the silicon layer of ejection chip 118, is an ejection mechanism, such as an electrical heater (thermal) or piezoelectric (electromechanical) device. The operation of such an ejection chip 118 and driver is well known in the micro-fluid ejection arts, such as in ink jet printing.

As used herein, each of the terms substantially orthogonal and substantially perpendicular is defined to mean an angular relationship between two elements of 90 degrees, plus or minus 10 degrees. The term substantially parallel is defined to mean an angular relationship between two elements of zero degrees, plus or minus 10 degrees.

As best shown in FIGS. 6 and 7, housing 112 includes a body 122, a lid 124, an end cap 126, and a fill plug 128 (e.g., ball). Contained within housing 112 is a backpres sure regulation member in the form of a diaphragm 130, a stir bar 132, and a guide portion 134. Each of the housing 112 components, stir bar 132, and guide portion 134 may be made of plastic, using a molding process. Diaphragm 130 is made of elastomeric material, such as rubber or a thermoplastic elastomer (TPE), using an appropriate molding process. Also, in the present embodiment, fill plug 128 may be in the form of a stainless steel ball bearing.

Figure 8:
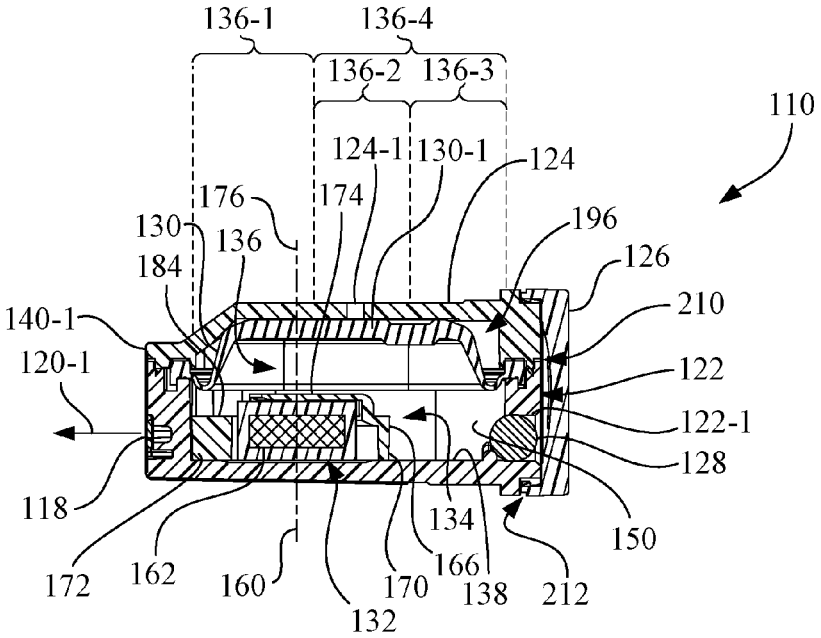
FIG. 8 is a section view of the microfluidic dispensing device of FIG. 1, taken along line 8-8 of FIG. 5.
Figure 9:
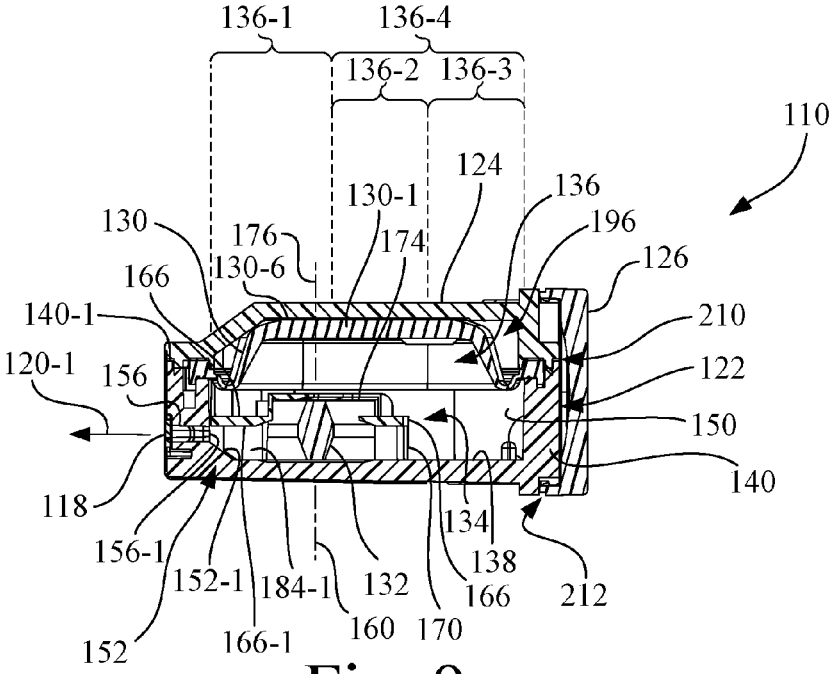
FIG. 9 is a section view of the microfluidic dispensing device of FIG. 1, taken along line 9-9 of FIG. 5.

Referring also to FIGS. 8 and 9, in general, a fluid (not shown) is loaded through a fill hole 122-1 in body 122 (see also FIG. 6) into a sealed region, i.e., a fluid reservoir 136, between body 122 and diaphragm 130. Back pressure in fluid reservoir 136 is set and then maintained by inserting, e.g., pressing, fill plug 128 into fill hole 122-1 to prevent air from leaking into fluid reservoir 136 or fluid from leaking out of fluid reservoir 136. End cap 126 is then placed onto an end of the body 122/lid 124 combination, opposite to ejection chip 118. Stir bar 132 resides in the sealed fluid reservoir 136 between body 122 and diaphragm 130 that contains the fluid. An internal fluid flow may be generated within fluid reservoir 136 by rotating stir bar 132 so as to provide fluid mixing and redistribution of particulate in the fluid within the sealed region of fluid reservoir 136.

Referring now also to FIGS. 10-16, body 122 of housing 112 has a base wall 138 and an exterior perimeter wall 140 contiguous with base wall 138. Exterior perimeter wall 140 is oriented to extend from base wall 138 in a direction that is substantially orthogonal to base wall 138. Lid 124 is configured to engage exterior perimeter wall 140. Thus, exterior perimeter wall 140 is interposed between base wall 138 and lid 124, with lid 124 being attached to the open free end of exterior perimeter wall 140 by weld, adhesive, or other fastening mechanism, such as a snap fit or threaded union. Attachment of lid 124 to body 122 forms a casing, and occurs after installation of diaphragm 130, stir bar 132, and guide portion 134 in body 122.

Figure 16:
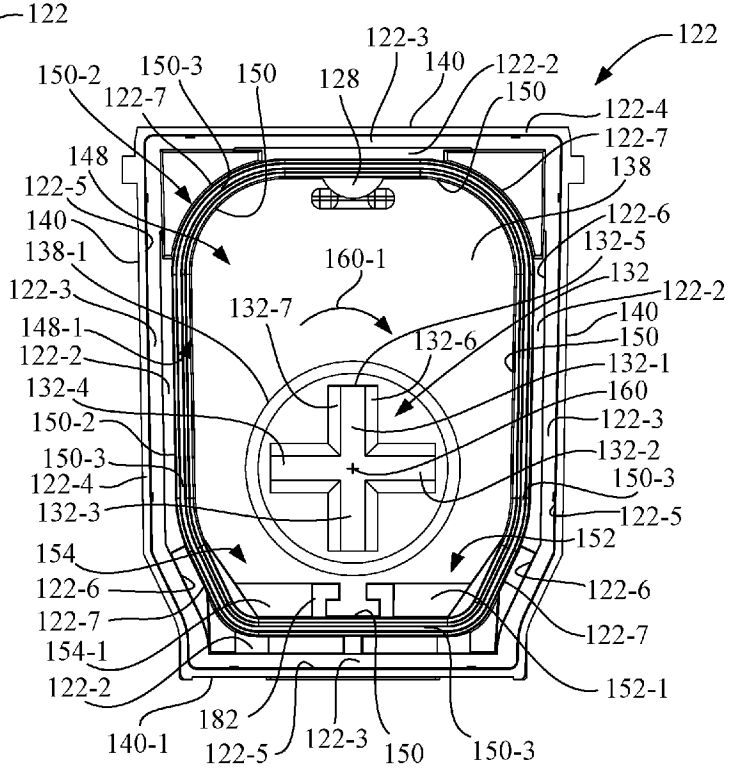
FIG. 16 is an enlarged view of the depiction of FIG. 12, with the guide portion removed to expose the stir bar residing in the chamber of the body.
Figure 15:
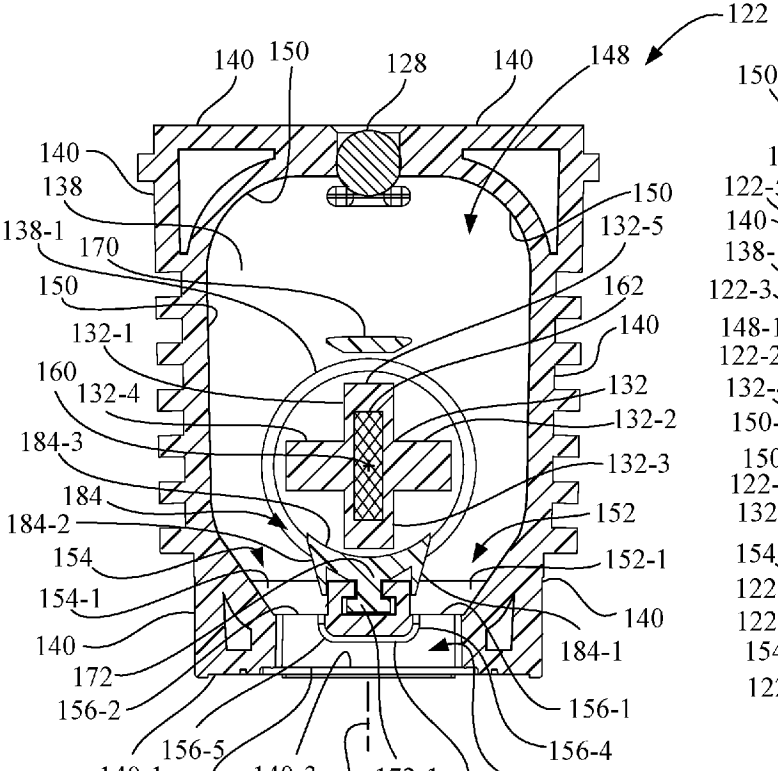
FIG. 15 is an enlarged section view of the body/guide portion/stir bar arrangement of FIGS. 12 and 13, taken along line 15-15 of FIG. 13.

Exterior perimeter wall 140 of body 122 includes an exterior wall 140-1, which is a contiguous portion of exterior perimeter wall 140. Exterior wall 140-1 has a chip mounting surface 140-2 that defines a plane 142 (see FIGS. 11 and 12), and has a fluid opening 140-3 adjacent to chip mounting surface 140-2 that passes through the thickness of exterior wall 140-1. Ejection chip 118 is mounted, e.g., by an adhesive sealing strip 144 (see FIGS. 6 and 7), to chip mounting surface 140-2 and is in fluid communication with fluid opening 140-3 (see FIG. 13) of exterior wall 140-1. Thus, the planar extent of ejection chip 118 is oriented along plane 142, with the plurality of ejection nozzles 120 oriented such that the fluid ejection direction 120-1 is substantially orthogonal to plane 142. Base wall 138 is oriented along a plane 146 (see FIG. 11) that is substantially orthogonal to plane 142 of exterior wall 140-1. As best shown in FIGS. 6, 15 and 16, base wall 138 may include a circular recessed region 138-1 in the vicinity of the desired location of stir bar 132.

Referring to FIGS. 11-16, body 122 of housing 112 also includes a chamber 148, i.e., a reservoir chamber, located within a boundary defined by exterior perimeter wall 140. Chamber 148 forms a portion of fluid reservoir 136, and is configured to define an interior space, and in particular, includes base wall 138 and has an interior perimetrical wall 150 configured to have rounded corners, so as to promote fluid flow in chamber 148. Interior perimetrical wall 150 of chamber 148 has an extent bounded by a proximal end 150-1 and a distal end 150-2. Proximal end 150-1 is contiguous with, and may form a transition radius with, base wall 138. Such an edge radius may help in mixing effectiveness by reducing the number of sharp corners. Distal end 150-2 is configured to define a perimetrical end surface 150-3 at a lateral opening 148-1 of chamber 148. Perimetrical end surface 150-3 may include a single perimetrical rib, or a plurality of perimetrical ribs or undulations as shown, to provide an effective sealing surface for engagement with diaphragm 130. The extent of interior perimetrical wall 150 of chamber 148 is substantially orthogonal to base wall 138, and is substantially parallel to the corresponding extent of exterior perimeter wall 140 (see FIG. 6).

As best shown in FIGS. 15 and 16, chamber 148 has an inlet fluid port 152 and an outlet fluid port 154, each of which is formed in a portion of interior perimetrical wall 150. The terms "inlet" and "outlet" are terms of convenience that are used in distinguishing between the multiple ports of the present embodiment, and are correlated with a particular rotational direction of stir bar 132. However, it is to be understood that it is the rotational direction of stir bar 132 that dictates whether a particular port functions as an inlet port or an outlet port, and it is within the scope of this invention to reverse the rotational direction of stir bar 132, and thus reverse the roles of the respective ports within chamber 148.

Inlet fluid port 152 is separated a distance from outlet fluid port 154 along a portion of interior perimetrical wall 150. As best shown in FIGS. 15 and 16, considered together, body 122 of housing 112 includes a fluid channel 156 interposed between the portion of interior perimetrical wall 150 of chamber 148 and exterior wall 140-1 of exterior perimeter wall 140 that carries ejection chip 118.

Fluid channel 156 is configured to minimize particulate settling in a region of ejection chip 118. Fluid channel 156 is sized, e.g., using empirical data, to provide a desired flow rate while also maintaining an acceptable fluid velocity for fluid mixing through fluid channel 156.

In the present embodiment, referring to FIG. 15, fluid channel 156 is configured as a U-shaped elongated passage having a channel inlet 156-1 and a channel outlet 156-2. Fluid channel 156 dimensions, e.g., height and width, and shape are selected to provide a desired combination of fluid flow and fluid velocity for facilitating intra-channel stirring.

Fluid channel 156 is configured to connect inlet fluid port 152 of chamber 148 in fluid communication with outlet fluid port 154 of chamber 148, and also connects fluid opening 140-3 of exterior wall 140-1 of exterior perimeter wall 140 in fluid communication with both inlet fluid port 152 and outlet fluid port 154 of chamber 148. In particular, channel inlet 156-1 of fluid channel 156 is located adjacent to inlet fluid port 152 of chamber 148 and channel outlet 156-2 of fluid channel 156 is located adjacent to outlet fluid port 154 of chamber 148. In the present embodiment, the structure of inlet fluid port 152 and outlet fluid port 154 of chamber 148 is symmetrical.

Fluid channel 156 has a convexly arcuate wall 156-3 that is positioned between channel inlet 156-1 and channel outlet 156-2, with fluid channel 156 being symmetrical about a channel mid-point 158. In turn, convexly arcuate wall 156-3 of fluid channel 156 is positioned between inlet fluid port 152 and outlet fluid port 154 of chamber 148 on the opposite side of interior perimetrical wall 150 from the interior space of chamber 148, with convexly arcuate wall 156-3 positioned to face fluid opening 140-3 of exterior wall 140-1 and ejection chip 118.

Convexly arcuate wall 156-3 is configured to create a fluid flow through fluid channel 156 that is substantially parallel to ejection chip 118. In the present embodiment, a longitudinal extent of convexly arcuate wall 156-3 has a radius that faces fluid opening 140-3 and that is substantially parallel to ejection chip 118, and has transition radii 156-4, 156-5 located adjacent to channel inlet 156-1 and channel outlet 156-2, respectively. The radius and transition radii 156-4, 156-5 of convexly arcuate wall 156-3 help with fluid flow efficiency. A distance between convexly arcuate wall 156-3 and fluid ejection chip 118 is narrowest at the channel mid-point 158, which coincides with a mid-point of the longitudinal extent of ejection chip 118, and in turn, with a mid-point of the longitudinal extent of fluid opening 140-3 of exterior wall 140-1.

Each of inlet fluid port 152 and outlet fluid port 154 of chamber 148 has a beveled ramp structure configured such that each of inlet fluid port 152 and outlet fluid port 154 converges in a respective direction toward fluid channel 156. In particular, inlet fluid port 152 of chamber 148 has a beveled inlet ramp 152-1 configured such that inlet fluid port 152 converges, i.e., narrows, in a direction toward channel inlet 156-1 of fluid channel 156, and outlet fluid port 154 of chamber 148 has a beveled outlet ramp 154-1 that diverges, i.e., widens, in a direction away from channel outlet 156-2 of fluid channel 156.

Referring again to FIGS. 6-10, diaphragm 130 is positioned between lid 124 and perimetrical end surface 150-3 of interior perimetrical wall 150 of chamber 148, such that diaphragm 130 is in fluid communication with chamber 148. The attachment of lid 124 to body 122 compresses a perimeter of diaphragm 130 thereby creating a continuous seal between diaphragm 130 and body 122. More particularly, diaphragm 130 is configured for sealing engagement with perimetrical end surface 150-3 of interior perimetrical wall 150 of chamber 148 in forming fluid reservoir 136.

Thus, in combination, chamber 148 and diaphragm 130 cooperate to define fluid reservoir 136 having a variable volume.

Referring particularly to FIGS. 1, 6, and 8, an exterior surface of diaphragm 130 may be vented to the atmosphere external to microfluidic dispensing device 110 through a vent hole 124-1 located in lid 124 so that a controlled negative pressure can be maintained in fluid reservoir 136. Diaphragm 130 is made of elastomeric material, and includes a dome portion 130-1 configured to progressively collapse toward base wall 138 as fluid is depleted from microfluidic dispensing device 110, so as to maintain a desired negative pressure (i.e., backpressure) in chamber 148, and thus changing the effective volume of the variable volume of fluid reservoir 136. As used herein, the term "collapse" means to fall in, as to buckle, sag, or deflect.

Referring to FIGS. 8 and 9, for sake of further explanation, below, the variable volume of fluid reservoir 136, also referred to herein as a bulk region, may be considered to have a proximal continuous ⅓ volume portion 136-1, and a continuous ⅔ volume portion 136-4 that is formed from a central continuous ⅓ volume portion 136-2 and a distal continuous ⅓ volume portion 136-3, with the central continuous ⅓ volume portion 136-2 separating the proximal continuous ⅓ volume portion 136-1 from the distal continuous ⅓ volume portion 136-3. The proximal continuous ⅓ volume portion 136-1 is located closer to ejection chip 118 than the continuous ⅔ volume portion 136-4 that is formed from the central continuous ⅓ volume portion 136-2 and the distal continuous ⅓ volume portion 136-3.

Referring to FIGS. 6-9 and 16, stir bar 132 resides in the variable volume of fluid reservoir 136 and chamber 148, and is located within a boundary defined by the interior perimetrical wall 150 of chamber 148. Stir bar 132 has a rotational axis 160 and a plurality of paddles 132-1, 132-2, 132-3, 132-4 that radially extend away from the rotational axis 160. Stir bar 132 has a magnet 162 (see FIG. 8), e.g., a permanent magnet, configured for interaction with an external magnetic field generator 164 (see FIG. 1) to drive stir bar 132 to rotate around the rotational axis 160. The principle of stir bar 132 operation is that as magnet 162 is aligned to a strong enough external magnetic field generated by external magnetic field generator 164, then rotating the external magnetic field generated by external magnetic field generator 164 in a controlled manner will rotate stir bar 132. The external magnetic field generated by external magnetic field generator 164 may be rotated electronically, akin to operation of a stepper motor, or may be rotated via a rotating shaft. Thus, stir bar 132 is effective to provide fluid mixing in fluid reservoir 136 by the rotation of stir bar 132 around the rotational axis 160.

Fluid mixing in the bulk region relies on a flow velocity caused by rotation of stir bar 132 to create a shear stress at the settled boundary layer of the particulate. When the shear stress is greater than the critical shear stress (empirically determined) to start particle movement, remixing occurs because the settled particles are now distributed in the moving fluid. The shear stress is dependent on both the fluid parameters such as: viscosity, particle size, and density; and mechanical design factors such as: container shape, stir bar 132 geometry, fluid thickness between moving and stationary surfaces, and rotational speed.

Also, a fluid flow is generated by rotating stir bar 132 in a fluid region, e.g., the proximal continuous ⅓ volume portion 136-1 and fluid channel 156, associated with ejection chip 118, so as to ensure that mixed bulk fluid is presented to ejection chip 118 for nozzle ejection and to move fluid adjacent to ejection chip 118 to the bulk region of fluid reservoir 136 to ensure that the channel fluid flowing through fluid channel 156 mixes with the bulk fluid of fluid reservoir 136, so as to produce a more uniform mixture. Although this flow is primarily distribution in nature, some mixing will occur if the flow velocity is sufficient to create a shear stress above the critical value.

Stir bar 132 primarily causes rotation flow of the fluid about a central region associated with the rotational axis 160 of stir bar 132, with some axial flow with a central return path as in a partial toroidal flow pattern.

Referring to FIG. 16, each paddle of the plurality of paddles 132-1, 132-2, 132-3, 132-4 of stir bar 132 has a respective free end tip 132-5. To reduce rotational drag, each paddle may include upper and lower symmetrical pairs of chamfered surfaces, forming leading beveled surfaces 132-6 and trailing beveled surfaces 132-7 relative to a rotational direction 160-1 of stir bar 132. It is also contemplated that each of the plurality of paddles 132-1, 132-2, 132-3, 132-4 of stir bar 132 may have a pill or cylindrical shape. In the present embodiment, stir bar 132 has two pairs of diametrically opposed paddles, wherein a first paddle of the diametrically opposed paddles has a first free end tip 132-5 and a second paddle of the diametrically opposed paddles has a second free end tip 132-5.

In the present embodiment, the four paddles forming the two pairs of diametrically opposed paddles are equally spaced at 90 degree increments around the rotational axis 160. However, the actual number of paddles of stir bar 132 may be two or more, and preferably three or four, but more preferably four, with each adjacent pair of paddles having the same angular spacing around the rotational axis 160. For example, a stir bar 132 configuration having three paddles may have a paddle spacing of 120 degrees, having four paddles may have a paddle spacing of 90 degrees, etc.

In the present embodiment, and with the variable volume of fluid reservoir 136 being divided as the proximal continuous ⅓ volume portion 136-1 and the continuous ⅔ volume portion 136-4 described above, with the proximal continuous ⅓ volume portion 136-1 being located closer to ejection chip 118 than the continuous ⅔ volume portion 136-4, the rotational axis 160 of stir bar 132 may be located in the proximal continuous ⅓ volume portion 136-1 that is closer to ejection chip 118. Stated differently, guide portion 134 is configured to position the rotational axis 160 of stir bar 132 in a portion of the interior space of chamber 148 that constitutes a ⅓ of the volume of the interior space of chamber 148 that is closest to fluid opening 140-3.

Referring again also to FIG. 11, the rotational axis 160 of stir bar 132 may be oriented in an angular range of perpendicular, plus or minus 45 degrees, relative to the fluid ejection direction 120-1. Stated differently, the rotational axis 160 of stir bar 132 may be oriented in an angular range of parallel, plus or minus 45 degrees, relative to the planar extent (e.g., plane 142) of ejection chip 118. In combination, the rotational axis 160 of stir bar 132 may be oriented in both an angular range of perpendicular, plus or minus 45 degrees, relative to the fluid ejection direction 120-1, and an angular range of parallel, plus or minus 45 degrees, relative to the planar extent of ejection chip 118.

More preferably, the rotational axis 160 has an orientation substantially perpendicular to the fluid ejection direction 120-1, and thus, the rotational axis 160 of stir bar 132 has an orientation that is substantially parallel to plane 142, i.e., planar extent, of ejection chip 118 and that is substantially perpendicular to plane 146 of base wall 138. Also, in the present embodiment, the rotational axis 160 of stir bar 132 has an orientation that is substantially perpendicular to plane 146 of base wall 138 in all orientations around rotational axis 160 and is substantially perpendicular to the fluid ejection direction 120-1.

Referring to FIGS. 6-9, 11, and 12, the orientations of stir bar 132, described above, may be achieved by guide portion 134, with guide portion 134 also being located within chamber 148 in the variable volume of fluid reservoir 136 (see FIGS. 8 and 9), and more particularly, within the boundary defined by interior perimetrical wall 150 of chamber 148. Guide portion 134 is configured to confine stir bar 132 in a predetermined portion of the interior space of chamber 148 at a predefined orientation, as well as to split and redirect the rotational fluid flow from stir bar 132 towards channel inlet 156-1 of fluid channel 156. On the return flow side, guide portion 134 helps to recombine the rotational flow received from channel outlet 156-2 of fluid channel 156 in the bulk region of fluid reservoir 136.

For example, guide portion 134 may be configured to position the rotational axis 160 of stir bar 132 in an angular range of parallel, plus or minus 45 degrees, relative to the planar extent of ejection chip 118, and more preferably, guide portion 134 is configured to position the rotational axis 160 of stir bar 132 substantially parallel to the planar extent of ejection chip 118. In the present embodiment, guide portion 134 is configured to position and maintain an orientation of the rotational axis 160 of stir bar 132 to be substantially parallel to the planar extent of ejection chip 118 and to be substantially perpendicular to plane 146 of base wall 138 in all orientations around rotational axis 160.

Guide portion 134 includes an annular member 166, a plurality of locating features 168-1, 168-2, offset members 170, 172, and a cage structure 174. The plurality of locating features 168-1, 168-2 are positioned on the opposite side of annular member 166 from offset members 170, 172, and are positioned to be engaged by diaphragm 130, which keeps offset members 170, 172 in contact with base wall 138. Offset members 170, 172 maintain an axial position (relative to the rotational axis 160 of stir bar 132) of guide portion 134 in fluid reservoir 136. Offset member 172 includes a retention feature 172-1 that engages body 122 to prevent a lateral translation of guide portion 134 in fluid reservoir 136.

Referring again to FIGS. 6 and 7, annular member 166 of guide portion 134 has a first annular surface 166-1, a second annular surface 166-2, and an opening 166-3 that defines an annular confining surface 166-4. Opening 166-3 of annular member 166 has a central axis 176. Annular confining surface 166-4 is configured to limit radial movement of stir bar 132 relative to the central axis 176. Second annular surface 166-2 is opposite first annular surface 166-1, with first annular surface 166-1 being separated from second annular surface 166-2 by annular confining surface 166-4. Referring also to FIG. 9, first annular surface 166-1 of annular member 166 also serves as a continuous ceiling over, and between, inlet fluid port 152 and outlet fluid port 154. The plurality of offset members 170, 172 are coupled to annular member 166, and more particularly, the plurality of offset members 170, 172 are connected to first annular surface 166-1 of annular member 166. The plurality of offset members 170, 172 are positioned to extend from annular member 166 in a first axial direction relative to the central axis 176. Each of the plurality of offset members 170, 172 has a free end configured to engage base wall 138 of chamber 148 to establish an axial offset of annular member 166 from base wall 138. Offset member 172 also is positioned and configured to aid in preventing a flow bypass of fluid channel 156.

The plurality of offset members 170, 172 are coupled to annular member 166, and more particularly, the plurality of offset members 170, 172 are connected to second annular surface 166-2 of annular member 166. The plurality of offset members 170, 172 are positioned to extend from annular member 166 in a second axial direction relative to the central axis 176, opposite to the first axial direction.

Thus, when assembled, each of locating features 168-1, 168-2 has a free end that engages a perimetrical portion of diaphragm 130, and each of the plurality of offset members 170, 172 has a free end that engages base wall 138, with base wall 138 facing diaphragm 130.

Figure 12:
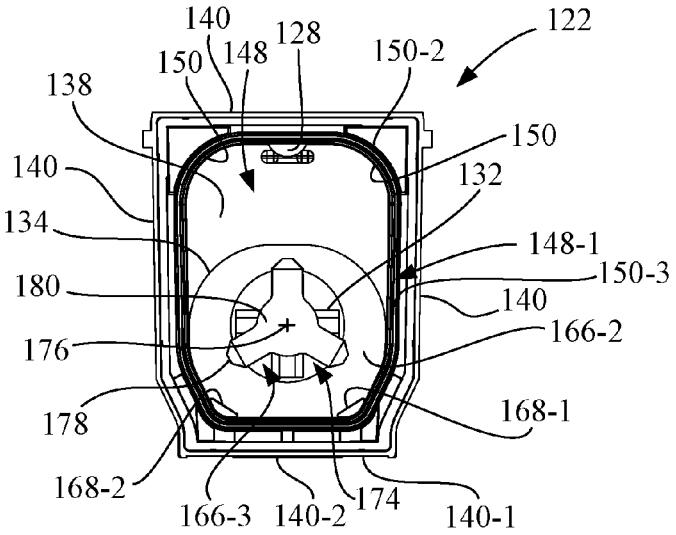
FIG. 12 is an orthogonal view of the body/guide portion/stir bar arrangement of FIG. 11, as viewed in a direction into the body of the chamber toward the base wall of the body.
Figure 13:
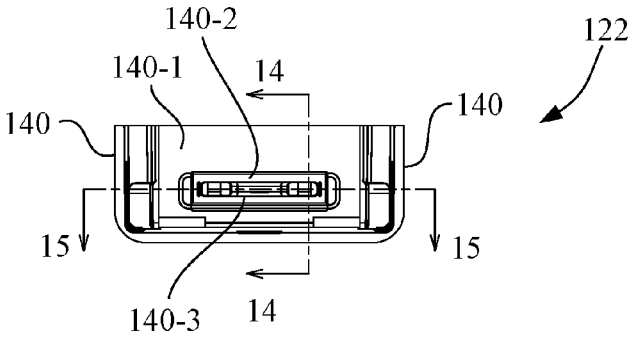
FIG. 13 is an orthogonal end view of the body of FIG. 11, which contains the guide portion and stir bar, as viewed in a direction toward the exterior wall and fluid opening of the body.

Cage structure 174 of guide portion 134 is coupled to annular member 166 opposite to the plurality of offset members 170, 172, and more particularly, the cage structure 174 has a plurality of offset legs 178 connected to second annular surface 166-2 of annular member 166. Cage structure 174 has an axial restraint portion 180 that is axially displaced by the plurality of offset legs 178 (three, as shown) from annular member 166 in the second axial direction opposite to the first axial direction. As shown in FIG. 12, axial restraint portion 180 is positioned over at least a portion of the opening 166-3 in annular member 166 to limit axial movement of stir bar 132 relative to the central axis 176 in the second axial direction. Cage structure 174 also serves to prevent diaphragm 130 from contacting stir bar 132 as diaphragm displacement (collapse) occurs during fluid depletion from fluid reservoir 136.

As such, in the present embodiment, stir bar 132 is confined within the region defined by opening 166-3 and annular confining surface 166-4 of annular member 166, and between axial restraint portion 180 of the cage structure 174 and base wall 138 of chamber 148. The extent to which stir bar 132 is movable within fluid reservoir 136 is determined by the radial tolerances provided between annular confining surface 166-4 and stir bar 132 in the radial direction, and by the axial tolerances between stir bar 132 and the axial limit provided by the combination of base wall 138 and axial restraint portion 180. For example, the tighter the radial and axial tolerances provided by guide portion 134, the less variation of the rotational axis 160 of stir bar 132 from perpendicular relative to base wall 138, and the less side-to-side motion of stir bar 132 within fluid reservoir 136.

In the present embodiment, guide portion 134 is configured as a unitary insert member that is removably attached to housing 112. Guide portion 134 includes retention feature 172-1 and body 122 of housing 112 includes a second retention feature 182. First retention feature 172-1 is engaged with second retention feature 182 to attach guide portion 134 to body 122 of housing 112 in a fixed relationship with housing 112. The first retention feature 172-1/second retention feature 182 may be, for example, in the form of a tab/slot arrangement, or alternatively, a slot/tab arrangement, respectively.

Referring to FIGS. 7 and 15, guide portion 134 may further include a flow control portion 184, which in the present embodiment, also serves as offset member 172. Referring to FIG. 15, flow control portion 184 has a flow separator feature 184-1, a flow rejoining feature 184-2, and a concavely arcuate surface 184-3. Concavely arcuate surface 184-3 is coextensive with, and extends between, each of flow separator feature 184-1 and flow rejoining feature 184-2. Each of flow separator feature 184-1 and flow rejoining feature 184-2 is defined by a respective angled, i.e., beveled, wall. Flow separator feature 184-1 is positioned adjacent inlet fluid port 152 and flow rejoining feature 184-2 is positioned adjacent outlet fluid port 154.

Figure 14:
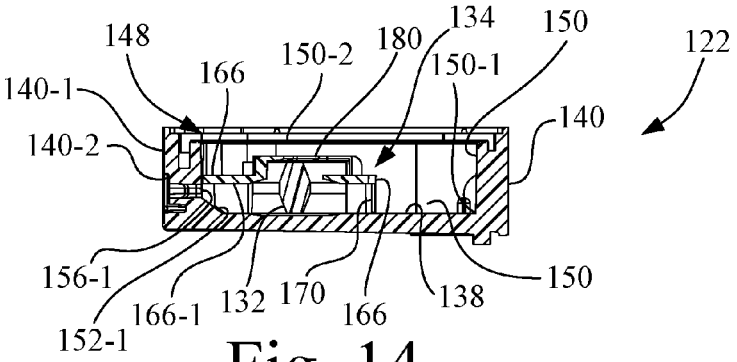
FIG. 14 is a section view of the body/guide portion/stir bar arrangement of FIGS. 12 and 13, taken along line 14-14 of FIG. 13.

The beveled wall of flow separator feature 184-1 positioned adjacent to inlet fluid port 152 of chamber 148 cooperates with beveled inlet ramp 152-1 of inlet fluid port 152 of chamber 148 to guide fluid toward channel inlet 156-1 of fluid channel 156. Flow separator feature 184-1 is configured such that the rotational flow is directed toward channel inlet 156-1 instead of allowing a direct bypass of fluid into the outlet fluid that exits channel outlet 156-2. Referring also to FIGS. 9 and 14, positioned opposite beveled inlet ramp 152-1 is the fluid ceiling provided by first annular surface 166-1 of annular member 166. Flow separator feature 184-1 in combination with the continuous ceiling of annular member 166 and beveled ramp wall provided by beveled inlet ramp 152-1 of inlet fluid port 152 of chamber 148 aids in directing a fluid flow into channel inlet 156-1 of fluid channel 156.

Likewise, referring to FIGS. 9, 14 and 15, the beveled wall of flow rejoining feature 184-2 positioned adjacent to outlet fluid port 154 of chamber 148 cooperates with beveled outlet ramp 154-1 of outlet fluid port 154 to guide fluid away from channel outlet 156-2 of fluid channel 156. Positioned opposite beveled outlet ramp 154-1 is the fluid ceiling provided by first annular surface 166-1 of annular member 166.

In the present embodiment, flow control portion 184 is a unitary structure formed as offset member 172 of guide portion 134. Alternatively, all or a portion of flow control portion 184 may be incorporated into interior perimetrical wall 150 of chamber 148 of body 122 of housing 112.

In the present embodiment, as best shown in FIG. 15, stir bar 132 is oriented such that the plurality of paddles 132-1, 132-2, 132-3, 132-4 periodically face the concavely arcuate surface 184-3 of the flow control portion 184 as stir bar 132 is rotated about the rotational axis 160. Stir bar 132 has a stir bar radius from rotational axis 160 to the free end tip 132-5 of a respective paddle. A ratio of the stir bar radius and a clearance distance between the free end tip 132-5 and flow control portion 184 may be 5:2 to 5:0.025. More particularly, guide portion 134 is configured to confine stir bar 132 in a predetermined portion of the interior space of chamber 148. In the present example, a distance between the respective free end tip 132-5 of each of the plurality of paddles 132-1, 132-2, 132-3, 132-4 and concavely arcuate surface 184-3 of flow control portion 184 is in a range of 2.0 millimeters to 0.1 millimeters, and more preferably, is in a range of 1.0 millimeters to 0.1 millimeters, as the respective free end tip 132-5 faces concavely arcuate surface 184-3. Also, it has been found that it is preferred to position stir bar 132 as close to ejection chip 118 as possible so as to maximize flow through fluid channel 156.

Also, guide portion 134 is configured to position the rotational axis 160 of stir bar 132 in a portion of fluid reservoir 136 such that the free end tip 132-5 of each of the plurality of paddles 132-1, 132-2, 132-3, 132-4 of stir bar 132 rotationally ingresses and egresses a proximal continuous ⅓ volume portion 136-1 that is closer to ejection chip 118. Stated differently, guide portion 134 is configured to position the rotational axis 160 of stir bar 132 in a portion of the interior space such that the free end tip 132-5 of each of the plurality of paddles 132-1, 132-2, 132-3, 132-4 rotationally ingresses and egresses the proximal continuous ⅓ volume portion 136-1 of the interior space of chamber 148 that includes inlet fluid port 152 and outlet fluid port 154.

More particularly, in the present embodiment, wherein stir bar 132 has four paddles, guide portion 134 is configured to position the rotational axis 160 of stir bar 132 in a portion of the interior space such that the first and second free end tips 132-5 of each the two pairs of diametrically opposed paddles 132-1, 132-3 and 132-2, 132-4 alternatingly and respectively are positioned in the proximal continuous ⅓ volume portion 136-1 of the volume of the interior space of chamber 148 that includes inlet fluid port 152 and outlet fluid port 154 and in the continuous ⅔ volume portion 136-4 having the distal continuous ⅓ volume portion 136-3 of the interior space that is furthest from ejection chip 118.

Figure 17:
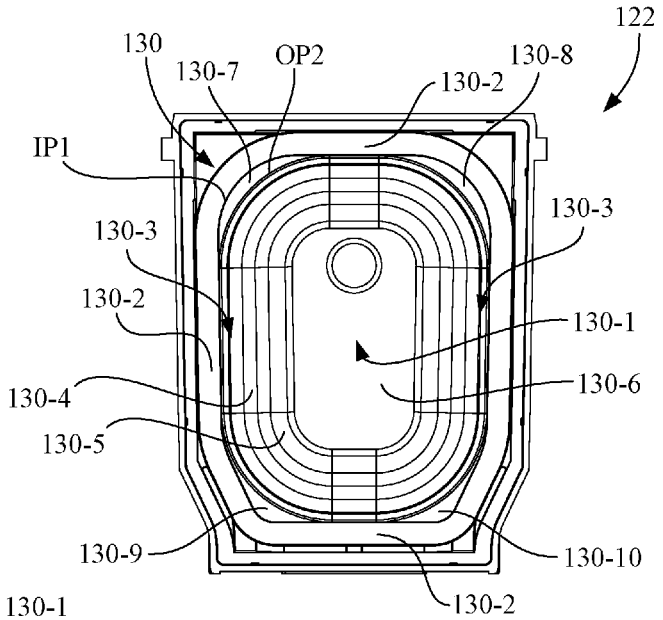
FIG. 17 is a top view of the microfluidic dispensing device of FIG. 1, corresponding to the perspective view of FIG. 10, having the end cap and lid removed to show a top view of the diaphragm that is positioned on the body.

Referring again to FIGS. 6-10, diaphragm 130 is positioned between lid 124 and perimetrical end surface 150-3 of interior perimetrical wall 150 of chamber 148. Referring also to FIGS. 16 and 17, diaphragm 130 is configured for sealing engagement with perimetrical end surface 150-3 of interior perimetrical wall 150 of chamber 148 in forming fluid reservoir 136 (see FIGS. 8 and 9).

Figure 10:
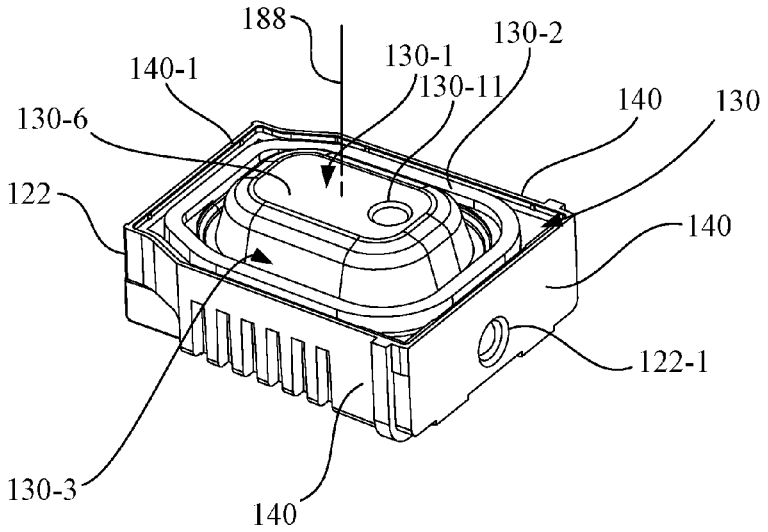
FIG. 10 is a perspective view of the microfluidic dispensing device of FIG. 1, with the end cap and lid removed to expose the body/diaphragm assembly.
Figure 11:
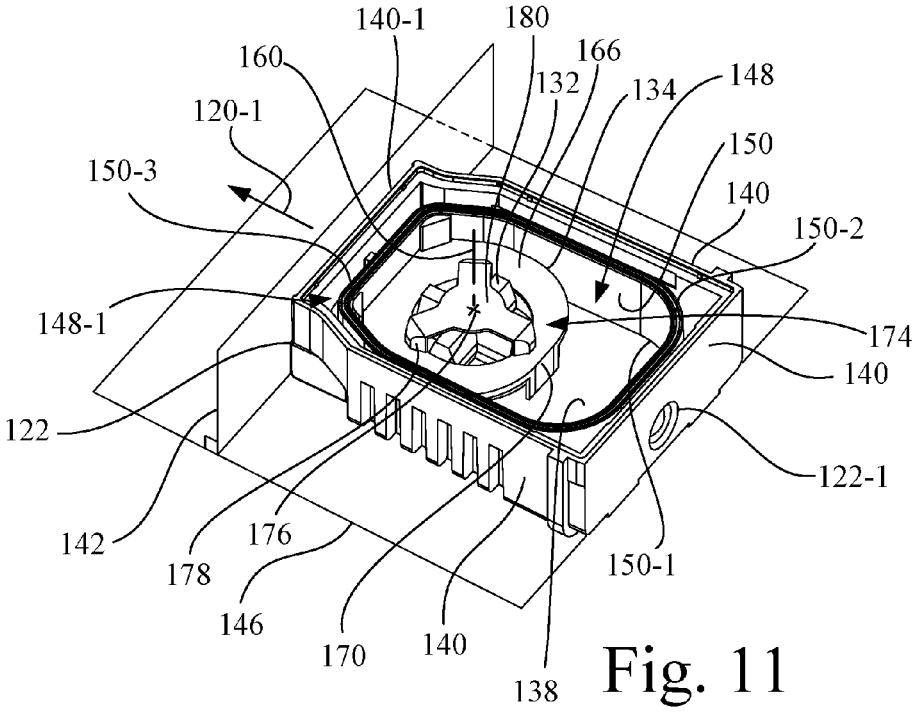
FIG. 11 is a perspective view of the depiction of FIG. 10, with the diaphragm removed to expose the guide portion and stir bar contained in the body, in relation to first and second planes and to the fluid ejection direction.

Referring to FIGS. 10 and 17, diaphragm 130 includes dome portion 130-1 and an exterior perimetrical rim 130-2. Dome portion 130-1 includes a dome deflection portion 130-3, a dome side wall 130-4, a dome transition portion 130-5, a dome crown 130-6, and four web portions, individually identified as central corner web 130-7, central corner web 130-8, central corner web 130-9, and central corner web 130-10. Dome deflection portion 130-3 and the four web portions 130-7, 130-8, 130-9, 130-10 join dome portion 130-1 to exterior perimetrical rim 130-2. In the orientation shown in FIG. 10, dome crown 130-6 includes a slight circular depression 130-11 in the right-most portion of dome crown 130-6 that is a manufacturing feature created during the molding of diaphragm 130, and does not affect the operation of diaphragm 130.

As will be described in more detail below, in the present embodiment, diaphragm 130 is configured such that during the collapse of diaphragm 130 during fluid depletion from fluid reservoir 136, the displacement of dome portion 130-1 is uniform with dome crown 130-6 of diaphragm 130 becoming concave, as viewed from the outside of diaphragm 130, and the direction of collapse, i.e., displacement, of dome portion 130-1 is along a deflection axis 188 that is substantially perpendicular to the fluid ejection direction 120-1 (see also FIG. 11), is substantially perpendicular to plane 146 of base wall 138, and is substantially parallel to plane 142 of chip mounting surface 140-2. In the present embodiment, a position of deflection axis 188 substantially corresponds to a central region of dome portion 130-1. Stated differently, during the collapse of diaphragm 130 during fluid depletion from fluid reservoir 136, the direction of the movement of dome crown 130-6 of dome portion 130-1 of diaphragm 130 is along deflection axis 188 toward base wall 138, and is substantially perpendicular to the fluid ejection direction 120-1, is substantially perpendicular to plane 146 of base wall 138, and is substantially parallel to plane 142 of chip mounting surface 140-2.

Also, as shown in FIGS. 6-10 and 17, microfluidic dispensing device 110 is configured such that diaphragm 130 is oriented to extend across the largest surface area of chamber 148 in forming fluid reservoir 136. As such, advantageously, an amount of movement of dome crown 130-6 of diaphragm 130 required to maintain the desired backpres sure in fluid reservoir 136 is less than would be required if a diaphragm were somehow installed at a side wall location of body 122.

Figure 18:
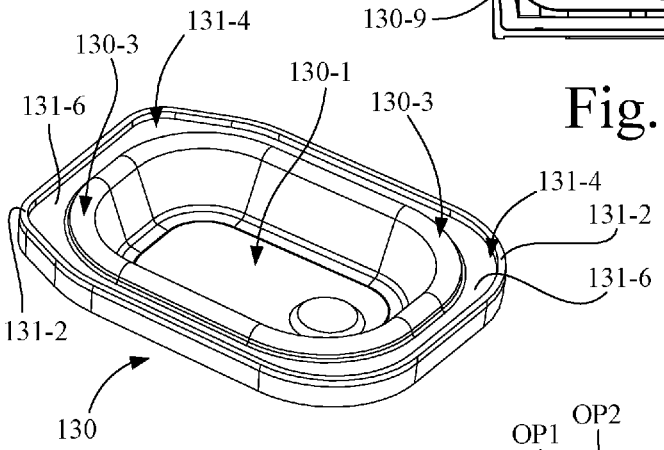
FIG. 18 is a bottom perspective view of the diaphragm of FIG. 17.
Figure 19:
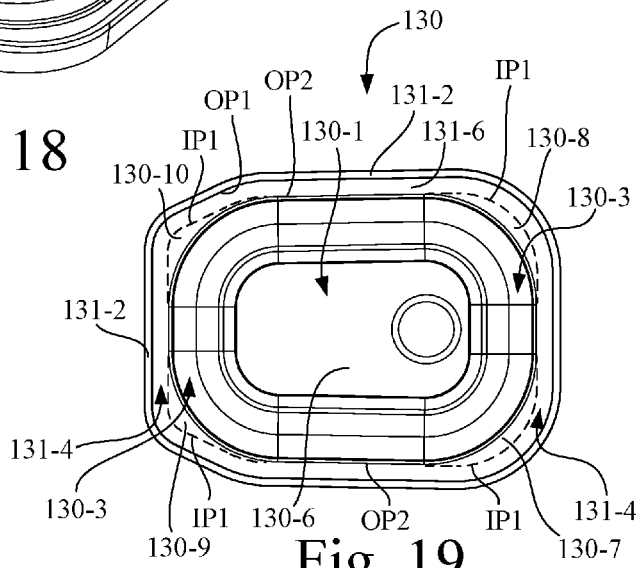
FIG. 19 is a bottom view of the diaphragm of FIGS. 17 and 18.

FIGS. 18 and 19 show a bottom, i.e., interior, view of diaphragm 130, wherein there is shown an interior perimetrical positioning rim 131-2, an interior of dome deflection portion 130-3, and an intermediate interior depressed region 131-4 interposed between interior perimetrical positioning rim 131-2 and dome deflection portion 130-3. Interior perimetrical positioning rim 131-2 aids in locating diaphragm 130 relative to body 122. A base of the intermediate interior depressed region 131-4 defines a continuous perimeter sealing surface 131-6. Referring to FIGS. 18-19, continuous perimeter sealing surface 131-6 has a planar extent that surrounds chamber 148 (see FIG. 16), and with the planar extent being substantially parallel to plane 146 of base wall 138 and substantially perpendicular to plane 142 (see FIG. 11). As such, referring also to FIG. 17, during the collapse of diaphragm 130 during fluid depletion from fluid reservoir 136, the direction of the movement of dome crown 130-6 of diaphragm 130 is substantially perpendicular to the planar extent of continuous perimeter sealing surface 131-6. Dome deflection portion 130-3 defines an undulated transition between dome side wall 130-4 and continuous perimeter sealing surface 131-6, as will be described in further detail below.

In the present embodiment, referring to FIG. 18, for example, interior perimetrical positioning rim 131-2, intermediate interior depressed region 131-4, continuous perimeter sealing surface 131-6, and dome deflection portion 130-3 may be concentrically arranged relative to each other. In the present embodiment, referring to FIG. 19, an outer perimetrical shape of an outer perimeter OP1 of continuous perimeter sealing surface 131-6 coincides with the outer perimetrical shape of interior perimetrical positioning rim 131-2. Referring to FIGS. 17 and 19, an inner perimetrical shape of an inner perimeter IP1 of exterior perimetrical rim 130-2 corresponds to the inner shape of continuous perimeter sealing surface 131-6 (FIG. 19), but inner perimeter IP1 does not coincide with the outer perimetrical shape of the outer perimeter OP2 of dome deflection portion 130-3 because the respective curved corners have different curved shapes, e.g., by having different radii. As such, and referring to FIG. 17, at each respective curved corner between the inner perimetrical shape of the inner perimeter of continuous perimeter sealing surface 131-6 and the outer perimetrical shape of the outer perimeter of dome deflection portion 130-3, there is defined a respective one of central corner webs 130-7, 130-8, 130-9, and 130-10 of diaphragm 130.

Referring also to FIG. 16, body 122 includes a stepped arrangement that includes a lower channel 122-2, an interior recessed surface 122-3, and an exterior rim 122-4. Exterior rim 122-4 has an upper inner side wall 122-5 that extends downwardly, in the orientation as shown, and vertically terminates at an outer edge of the interior recessed surface 122-3. Channel 122-2 has a lower inner side wall 122-6 that extends upwardly, in the orientation as shown, to vertically terminate at an inner edge of the interior recessed surface 122-3. As such, each of upper inner side wall 122-5 and lower inner side wall 122-6 is substantially perpendicular to the interior recessed surface 122-3, with upper inner side wall 122-5 being laterally offset from lower inner side wall 122-6 by a width of interior recessed surface 122-3, and with upper inner side wall 122-5 and lower inner side wall 122-6 being vertically offset by interior recessed surface 122-3.

Channel 122-2 further includes an inner perimetrical side wall 122-7, that also forms an outer perimeter surface portion of interior perimetrical wall 150, and that is laterally spaced inwardly from the lower inner side wall 122-6, such that inner perimetrical side wall 122-7 is the innermost side wall of channel 122-2 and lower inner side wall 122-6 is the outermost side wall of channel 122-2. In particular, channel 122-2 having lower inner side wall 122-6 and inner perimetrical side wall 122-7 defines a recessed path in body 122 around perimetrical end surface 150-3 of body 122, with the inner perimetrical side wall 122-7 vertically terminating at an outer edge of perimetrical end surface 150-3 of body 122.

Referring to FIG. 16, channel 122-2 of body 122 is sized and shaped to receive and guide interior perimetrical positioning rim 131-2 of diaphragm 130, with interior perimetrical positioning rim 131-2 contacting inner perimetrical side wall 122-7, and with lower inner side wall 122-6 of channel 122-2 of body 122 being intermittently engaged by a perimeter of exterior perimetrical rim 130-2 of diaphragm 130, so as to guide diaphragm 130 into a proper position with body 122. Also, the continuous perimeter sealing surface 131-6 of diaphragm 130 is sized and shaped to engage perimetrical end surface 150-3 of body 122 so as to facilitate a closed sealing engagement of diaphragm 130 with body 122. Thus, when diaphragm 130 is properly positioned relative to body 122 by interior perimetrical positioning rim 131-2 and channel 122-2, continuous perimeter sealing surface 131-6 of diaphragm 130 is positioned to engage perimetrical end surface 150-3 of body 122 around an entirety of perimetrical end surface 150-3. In the present embodiment, perimetrical end surface 150-3 may include a single perimetrical rib, or a plurality of perimetrical ribs or undulations as shown, to provide an effective sealing surface for engagement with continuous perimeter sealing surface 131-6 of diaphragm 130.

Figure 20:
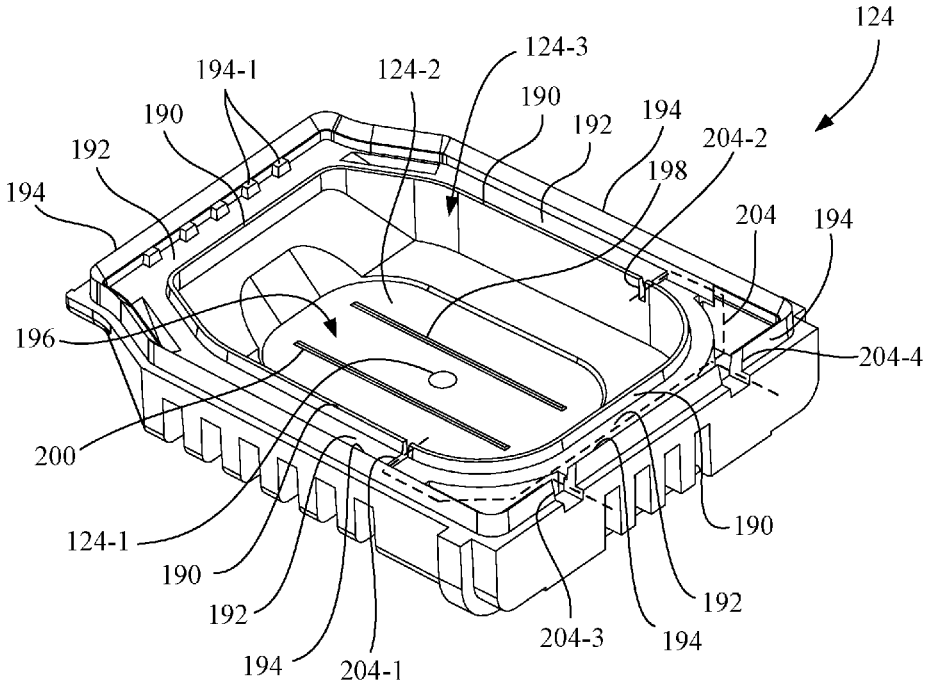
FIG. 20 is a bottom perspective view of the lid of FIGS. 6-9.
Figure 21:
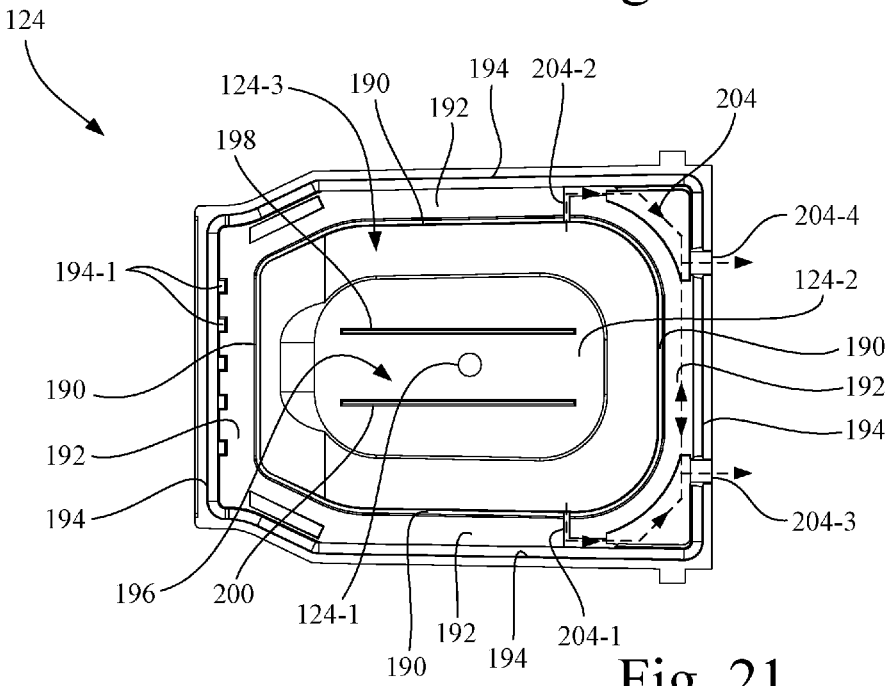
FIG. 21 is a bottom view of the lid of FIGS. 6-9 and 20.

FIGS. 20 and 21 show an interior, or underside, of lid 124 having a recessed interior ceiling 124-2 that defines a recessed region 124-3 that is configured to accommodate a full (non-collapsed) height of dome portion 130-1 of diaphragm 130. Lid 124 further includes an interior positioning lip 190, a diaphragm pressing surface 192, and an exterior positioning lip 194, each of which laterally surrounds recessed region 124-3, as best shown in FIGS. 20 and 21. Diaphragm pressing surface 192 is recessed between interior positioning lip 190 and exterior positioning lip 194.

Exterior positioning lip 194 is used to position lid 124 relative to body 122. In particular, during assembly, exterior positioning lip 194 is received and guided by upper inner side wall 122-5 of exterior rim 122-4 into contact with interior recessed surface 122-3 of body 122 (see also FIG. 16). Also, the apex rim (sacrificial material) of exterior positioning lip 194 will be melted and joined to body 122 at interior recessed surface 122-3 during an ultrasonic welding process to attached lid 124 to body 122. While ultrasonic welding is a current preferred method for attachment of lid 124 to body 122 in the present embodiment, it is contemplated that in some applications, another attachment method may be desired, such as for example, laser welding, mechanical attachment, adhesive attachment, etc.

Referring to FIGS. 17, 18, 20, and 21, interior positioning lip 190 of lid 124 is used to position diaphragm 130 relative to lid 124, and interior perimetrical positioning rim 131-2 of diaphragm 130 is used to position diaphragm 130 relative to body 122. In particular, as shown in FIG. 17, interior positioning lip 190 of lid 124 is sized and shaped to receive thereover the inner perimeter IP1 of exterior perimetrical rim 130-2, so as to position exterior perimetrical rim 130-2 of diaphragm 130 in opposition to diaphragm pressing surface 192 of lid 124.

In addition, referring again to FIGS. 20 and 21, the present embodiment may include a plurality of diaphragm positioning features 194-1 that extend inwardly from exterior positioning lip 194. The plurality of diaphragm positioning features 194-1 are located to engage an external perimeter of exterior perimetrical rim 130-2 of diaphragm 130 to help position diaphragm 130 relative to lid 124. More particularly, in the present embodiment, exterior perimetrical rim 130-2 of diaphragm 130 is received in the region between interior positioning lip 190 of lid 124 and the plurality of diaphragm positioning features 194-1 of lid 124, and interior perimetrical positioning rim 131-2 of diaphragm 130 is positioned in channel 122-2 of body 122, and thereby together help to prevent the dome bending features, such as dome deflection portion 130-3, and continuous perimeter sealing surface 131-6, from being unduly distorted, or continuous perimeter sealing surface 131-6 from leaking, during assembly or negative pressure dome deflections of dome portion 130-1. Also, interior positioning lip 190 of lid 124 and interior perimetrical positioning rim 131-2 of diaphragm 130 collectively limit an amount of seal distortion during collapse of diaphragm 130 when vacuum is generated in fluid reservoir 136 of microfluidic dispensing device 110 during assembly.

Referring again to FIGS. 20 and 21, diaphragm pressing surface 192 of lid 124 is planar, having a uniform height, so as to provide substantially uniform perimeter compression of diaphragm 130 (see also FIGS. 9-11, 17 and 19) at continuous perimeter sealing surface 131-6 around dome portion 130-1. In particular, diaphragm pressing surface 192 of lid 124 is sized and shaped to force continuous perimeter sealing surface 131-6 of diaphragm 130 into sealing engagement with perimetrical end surface 150-3 of body 122 around an entirety of perimetrical end surface 150-3 of body 122, when lid 124 is attached to body 122.

Referring to FIGS. 8 and 9, a dome (primary) vent chamber 196 having a variable volume is defined in the region between dome portion 130-1 of diaphragm 130 and lid 124, and is adjacent diaphragm 130. As fluid is depleted from fluid reservoir 136, dome portion 130-1 of diaphragm 130 collapses accordingly, thus increasing the volume of dome (primary) vent chamber 196, while decreasing the volume of fluid reservoir 136, so as to maintain the desired backpressure in fluid reservoir 136.

Referring again to FIGS. 20 and 21, located on interior ceiling 124-2 of lid 124 is a rib 198 and a rib 200, with rib 198 being spaced apart from rib 200. Vent hole 124-1 is located in lid 124 between ribs 198, 200. Ribs 198, 200 provide a spacing between interior ceiling 124-2 of lid 124 and dome portion 130-1 of diaphragm 130 in a region of dome (primary) vent chamber 196 around vent hole 124-1 (see also FIGS. 8 and 17). As such, ribs 198, 200 help to avoid a sticking contact between dome portion 130-1 of diaphragm 130 and interior ceiling 124-2 of lid 124, which could result in an undesirable de-priming of ejection chip 118 because the sticking would prevent a collapse of dome portion 130-1 as ink is depleted from chamber 148.

Figure 3:
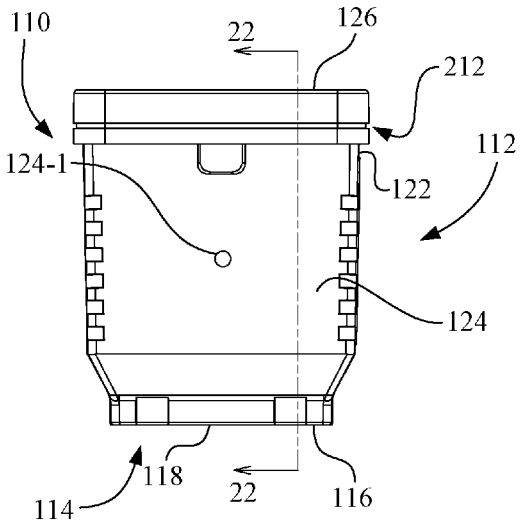
FIG. 3 is a top orthogonal view of the microfluidic dispensing device of FIGS. 1 and 2.
Figure 4:
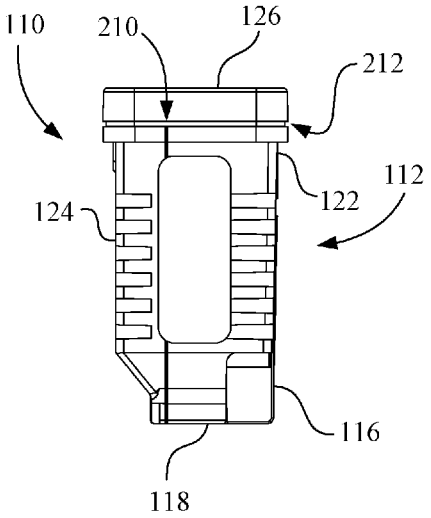
FIG. 4 is a side orthogonal view of the microfluidic dispensing device of FIGS. 1 and 2.
Figure 5:
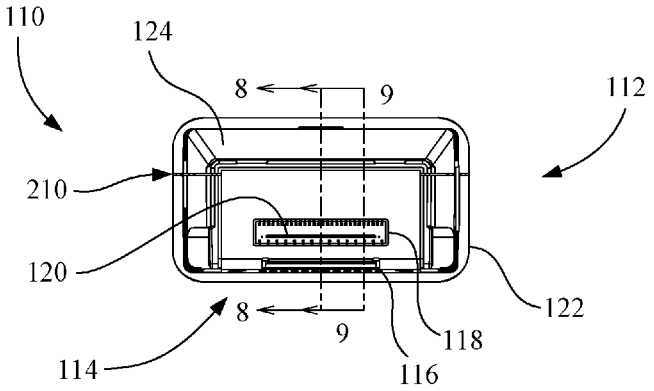
FIG. 5 is an end orthogonal view of the microfluidic dispensing device of FIGS. 1 and 2.
Figure 22:
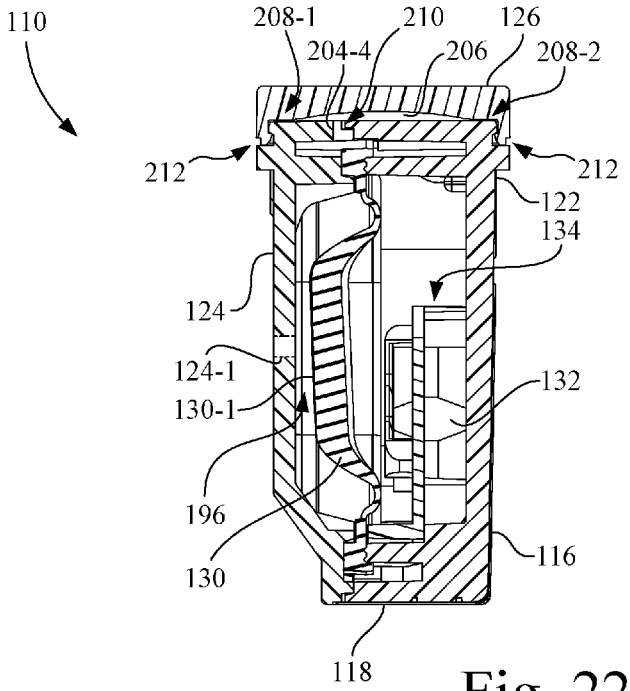
FIG. 22 is a section view of the microfluidic dispensing device of FIG. 1, taken along line 22-22 of FIG. 3.
Figure 23:
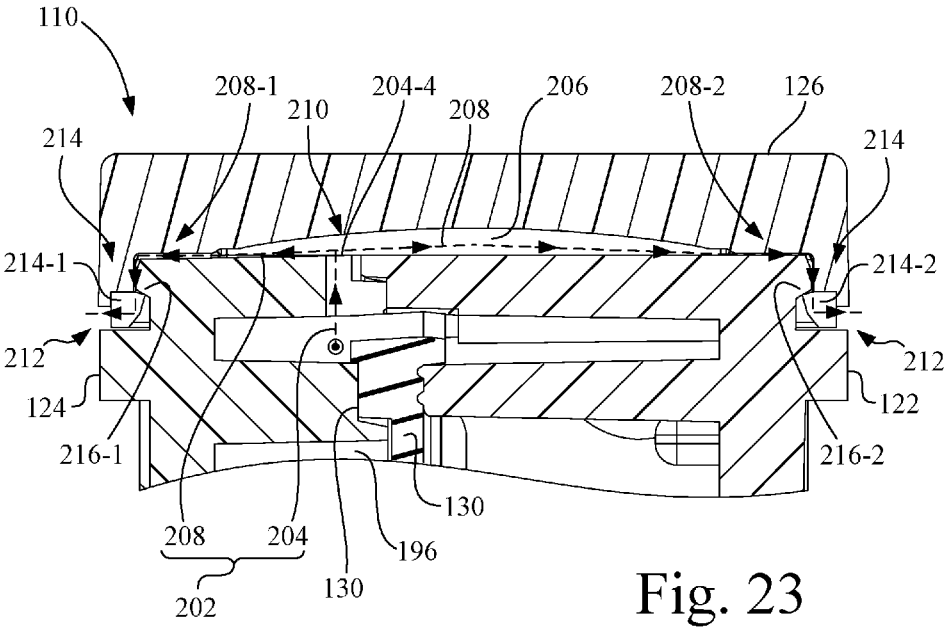
FIG. 23 is an enlargement of a portion of the section view of FIG. 22.

Referring also to FIGS. 3, 22 and 23, microfluidic dispensing device 110 includes a vent path 202 (depicted by arrowed dashed lines) to vent the region (i.e., the dome (primary) vent chamber 196) between dome portion 130-1 of diaphragm 130 and lid 124, to the atmosphere external to microfluidic dispensing device 110. Vent path 202 provides alternative or supplemental venting to that provided by the vent hole 124-1 (see FIG. 3) formed in a central portion of lid 124. Vent path 202 facilitates fluid (e.g., air) communication between the backpressure regulation member, which in the present embodiment is diaphragm 130, and the atmosphere external to microfluidic dispensing device 110. Stated differently, vent path 202 facilitates fluid communication between dome (primary) vent chamber 196 (see also FIGS. 8 and 9) adjacent diaphragm 130 and the atmosphere external to microfluidic dispensing device 110.

In the present embodiment, vent path 202 includes a first vent path portion 204 (see FIGS. 20, 21 and 23), a secondary vent chamber 206 (see FIGS. 22 and 23), and a second vent path portion 208 (see FIG. 23).

First vent path portion 204 is defined between lid 124 and body 122. First vent path portion 204 extends from, and is in direct fluid communication with, dome (primary) vent chamber 196 (see also FIGS. 8, 9, 20, and 21). First vent path portion 204 extends through a gap 210 between body 122 and lid 124 (see FIGS. 8, 9 and 23) to, and is in direct fluid communication with, secondary vent chamber 206. Secondary vent chamber 206 is a void, e.g., a dome-shaped void, which is located between end cap 126 and the corresponding end portion of body 122 and lid 124. Secondary vent chamber 206 is interposed in vent path 202 between the dome (primary) vent chamber 196 and the atmosphere.

Referring to FIGS. 20 and 21, first vent path portion 204 includes a dome vent path 204-1, a dome vent path 204-2, a side vent opening 204-3 and a side vent opening 204-4, thus providing multiple venting pathways between dome (primary) vent chamber 196 and secondary vent chamber 206.

In the present embodiment, each of dome vent path 204-1 and a dome vent path 204-2 is formed as an opening in interior positioning lip 190 and diaphragm pressing surface 192 of lid 124. More particularly, in the present embodiment, dome vent path 204-1 and a dome vent path 204-2 are located on opposite sides of, and laterally extend through, interior positioning lip 190 and diaphragm pressing surface 192 of lid 124.

Each of dome vent paths 204-1, 204-2 is in fluid communication with one or both of side vent openings 204-3, 204-4 via void regions between body 122 and lid 124. Each of side vent opening 204-3 and side vent opening 204-4 is formed as a lateral opening in exterior positioning lip 194, and is in direct fluid communication with secondary vent chamber 206. Side vent opening 204-3 is spaced apart from side vent opening 204-4 along the perimetrical extent of exterior positioning lip 194. In the present embodiment, while spaced apart, side vent openings 204-3, 204-4 are located to be covered by end cap 126. It is contemplated that in an embodiment that does not include end cap 126, each of side vent opening 204-3 and a side vent opening 204-4 would be in direct fluid communication with the atmosphere external to microfluidic dispensing device 110.

Referring to FIG. 23, second vent path portion 208 extends from, and is in direct fluid communication with, secondary vent chamber 206. Second vent path portion 208 extends through a fluid-penetrable gap 212 between end cap 126 and each of body 122 and lid 124 (see also FIGS. 1-4, 8 and 9), and to the atmosphere. Second vent path portion 208 provides multiple venting pathways around the periphery of gap 212, and includes, for example, a cap vent path 208-1 and a cap vent path 208-2 depicted in FIG. 23, so as to complete vent path 202 from dome (primary) vent chamber 196 to the atmosphere.

Referring to FIG. 23, end cap 126 is removably connected to the combination of body 122 and lid 124 at gap 212 by a latching mechanism 214 that produces a snap-fit connection. Latching mechanism 214 includes a plurality of latch members, including latch member 214-1 and latch member 214-2, and a plurality of catch members, including catch member 216-1 and catch member 216-2. Latch member 214-1 and latch member 214-2 extend inwardly from the periphery of end cap 126. Catch member 216-1 and catch member 216-2 extend outwardly from the periphery of lid 124 and body 122, respectively. The configuration of latching mechanism 214 is such that while end cap 126 is easily installed by application of a force against end cap 126, release is somewhat more difficult, requiring a prying of an end of end cap 126 outwardly at gap 212, so as to disconnect latch member 214-1 from catch member 216-1 and/or to disconnect latch member 214-2 from catch member 216-2.

In the present embodiment, vent hole 124-1 (see FIGS. 3, 22) and vent path 202 (see FIG. 23) facilitate fluid communication and venting redundancy between dome (primary) vent chamber 196, i.e., the exterior of dome portion 130-1 (see also FIG. 22), and the atmosphere external to microfluidic dispensing device 110. Moreover, referring to FIGS. 21-23, vent hole 124-1, dome vent path 204-1, and dome vent path 204-2 provide venting redundancy to the region of dome (primary) vent chamber 196 between dome portion 130-1 of diaphragm 130 and the interior ceiling 124-2 of lid 124, so as to facilitate a collapse of dome portion 130-1 as fluid is depleted from microfluidic dispensing device 110, even if one of the vent hole 124-1 and vent path 202 (see also FIG. 23) is blocked.

For example, even if vent hole 124-1 was blocked, such as by product labeling, or removed for aesthetic reasons, venting of the region between dome portion 130-1 and lid 124 is maintained by vent path 202, and more particularly, by first vent path portion 204 having one or more of dome vent path 204-1 and a dome vent path 204-2 in fluid communication with one or more of side vent openings 204-3, 204-4, which in turn are in fluid communication with the atmosphere at gap 212 via the combination of secondary vent chamber 206 and second vent path portion 208. Further, since second vent path portion 208 is in direct fluid communication with the atmosphere around the periphery of gap 212, vent path 202 cannot be completely blocked at gap 212 from communication with the atmosphere without sealing an entire periphery at gap 212, i.e., on all four sides of microfluidic dispensing device 110.

FIGS. 24-30 depict another embodiment of a microfluidic dispensing device 300 that includes a vent path 302 (represented by arrowed dashed lines) in accordance with the present invention.

Referring to FIGS. 24-28, microfluidic dispensing device 300 includes a housing 304 and a tape automated bonding (TAB) circuit 306. Microfluidic dispensing device 300 is configured to contain a supply of a fluid, and TAB circuit 306 is configured to facilitate the ejection of the fluid from housing 304. The fluid may be, for example, cosmetics, lubricants, paint, ink, etc.

Figure 28:
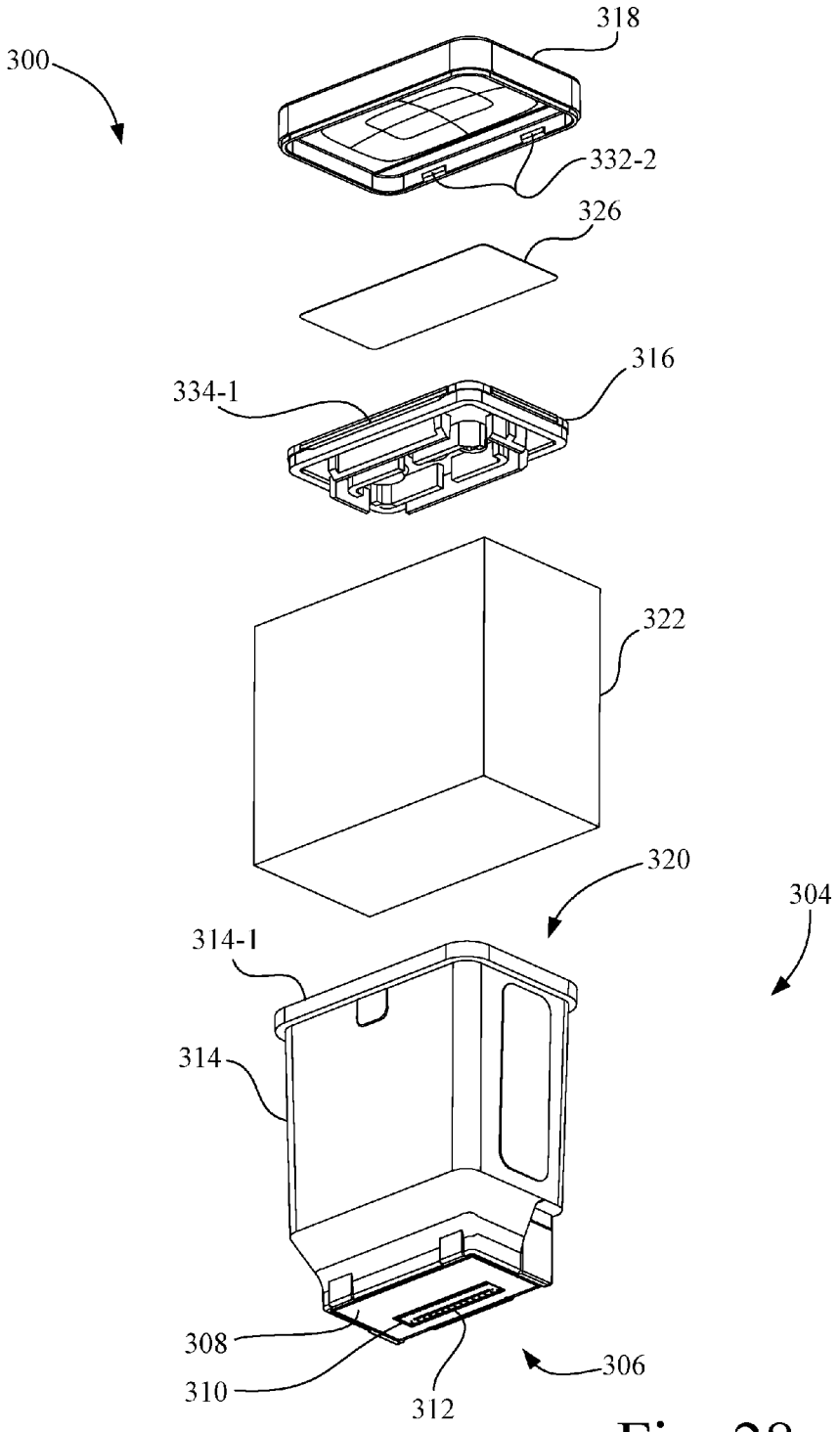
FIG. 28 is an exploded perspective view corresponding to the perspective view of the microfluidic dispensing device of FIG. 24, showing the end cap, cover member, lid, and capillary member separated from the body.

As best shown in FIG. 28, TAB circuit 306 includes a flex circuit 308 to which an ejection chip 310 is mechanically and electrically connected. Flex circuit 308 provides electrical connection to an electrical driver device (not shown), such as an ink jet printer, configured to operate ejection chip 310 to eject the fluid that is contained within housing 304. In the present embodiment, ejection chip 310 is configured as a plate-like structure having a planar extent formed generally as a nozzle plate layer and a silicon layer, as is well known in the art. The nozzle plate layer of ejection chip 310 has a plurality of ejection nozzles 312 (see FIG. 28).

Figure 26:
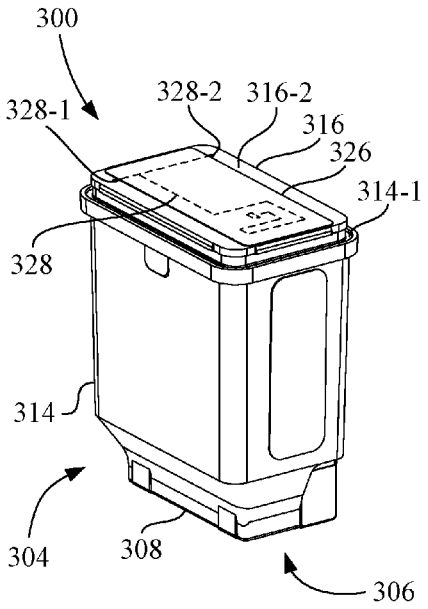
FIG. 26 is a perspective view corresponding to the perspective view of the microfluidic dispensing device of FIG. 24, with the end cap removed.
Figure 27:
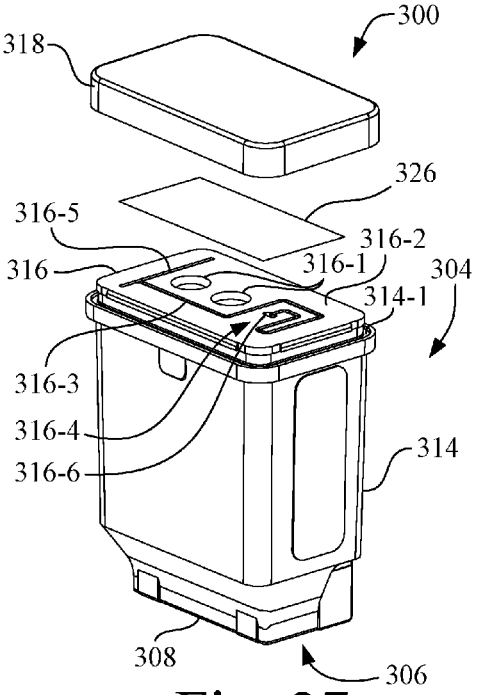
FIG. 27 is a partially exploded perspective view corresponding to the perspective view of the microfluidic dispensing device of FIG. 24, showing the end cap and cover member separated from the lid.

Referring to FIGS. 24-30, housing 304 includes a body casing 314, a lid 316, and an end cap 318, each of which may be made of plastic using a molding process. Referring to FIGS. 26-28, body casing 314 has an open perimetrical end 314-1 and a chamber 320 (FIG. 28), i.e., a reservoir chamber, with open perimetrical end 314-1 providing access to chamber 320.

Figure 29:
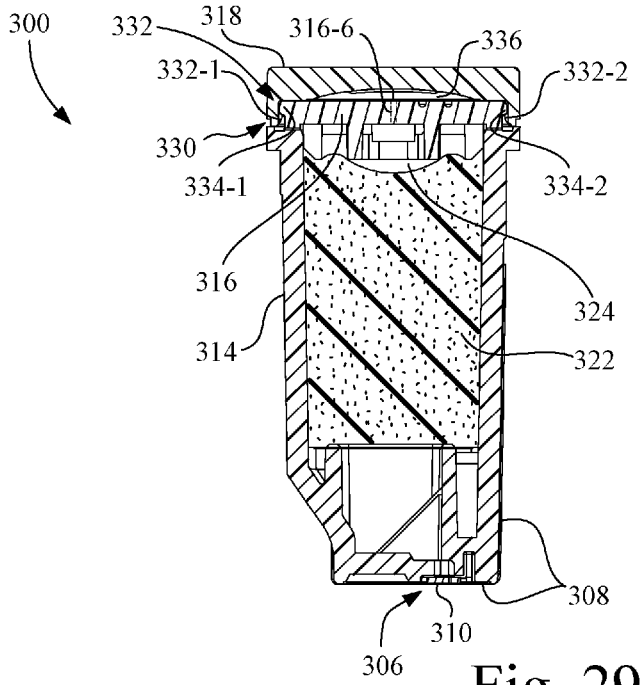
FIG. 29 is a section view of the microfluidic dispensing device of FIG. 24, taken along line 29-29 of FIG. 25.
Figure 30:
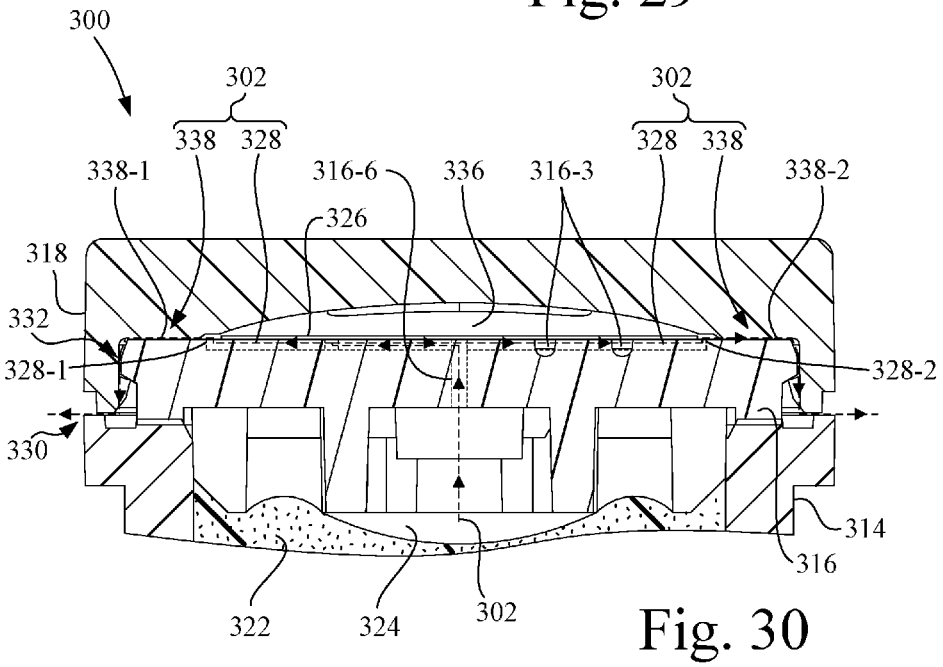
FIG. 30 is an enlargement of a portion of the section view of FIG. 29.

Referring to FIGS. 28-30, a backpressure regulation member in the form of a capillary member 322 is received through open perimetrical end 314-1 and is positioned within chamber 320 of body casing 314, such that capillary member 322 and chamber 320 in combination form a fluid reservoir. Capillary member 322 may be formed, for example, as a block of a porous material, such as foam or felt.

Figure 24:
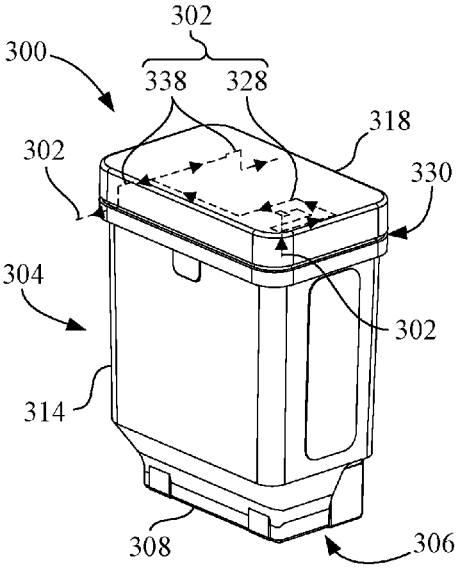
FIG. 24 is a perspective view of a microfluidic dispensing device in accordance with another embodiment of the present invention.
Figure 25:
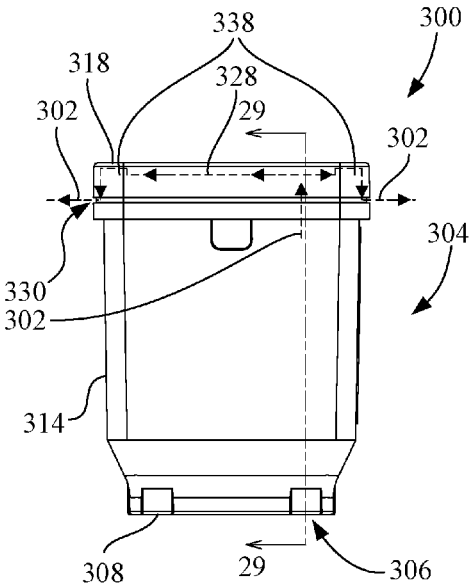
FIG. 25 is an orthogonal view of the microfluidic dispensing device of FIG. 24.

Referring again to FIGS. 26-28, lid 316 is positioned over chamber 320 and is attached, e.g., via ultrasonic welding or adhesive, to open perimetrical end 314-1 of body casing 314. As shown in FIG. 27, lid 316 includes one or more access openings 316-1 through which a fluid is injected into chamber 320 and received into the pores of capillary member 322. Once the fluid is supplied into chamber 320, each of the access openings 316-1 is sealed, e.g., by a plug, such as a ball bearing, or a cover member 326, so as to prevent air from leaking into chamber 320 or fluid from leaking out of chamber 320 through lid 316 in unintended areas. Referring to FIGS. 29 and 30, a primary vent chamber 324 is defined in the region between capillary member 322 and lid 316, and is adjacent capillary member 322. Referring to FIGS. 24, 29 and 30, vent path 302 extends from primary vent chamber 324 to the atmosphere.

Referring again to FIG. 27, lid 316 includes an upper surface 316-2 into which a tortuous venting channel 316-3 is established, e.g., by cutting or during a molding process. Tortuous venting channel 316-3 has a proximal end 316-4 and a distal end channel 316-5. At proximal end 316-4, a vent hole 316-6 passes through a thickness of lid 316 to facilitate a fluid communication with primary vent chamber 324, and in turn, with capillary member 322 that is positioned in chamber 320 (see also FIGS. 29 and 30).

Referring also to FIG. 26, cover member 326, e.g., an adhesive tape, is attached to upper surface 316-2 to cover over a vast majority (e.g., 95 to 99.9 percent) of tortuous venting channel 316-3 to define a tortuous vent path portion 328 (see also FIGS. 24 and 25) of vent path 302 having at least one vent opening 328-1, and in the present embodiment includes two vent openings 328-1, 328-2 located at opposite ends of distal end channel 316-5 of tortuous venting channel 316-3 (see FIGS. 27 and 30).

Referring to FIGS. 27-30, end cap 318 is placed onto an end of the body casing 314/lid 316 combination, opposite to ejection chip 118. Referring to FIGS. 29-30, end cap 318 is removably connected to lid 316 at a fluid-penetrable gap 330 of end cap 318 with lid 316 and with body casing 314, by a latching mechanism 332 that produces a snap-fit connection. Latching mechanism 332 includes a plurality of latch members, including latch member 332-1 and latch member 332-2 (see also FIG. 28), and a plurality of catch members, including catch member 334-1 and catch member 334-2. Referring to FIG. 29, latch member 332-1 and latch member 332-2 extend inwardly from the periphery of end cap 318. Catch member 334-1 and catch member 334-2 extend outwardly from the periphery of lid 316. The configuration of latching mechanism 332 is such that while end cap 318 is easily installed by application of a force against end cap 318, release is somewhat more difficult, requiring a prying of end cap 318 outwardly at gap 330, so as to disconnect latch member 332-1 from catch member 334-1 and/or to disconnect latch member 332-2 from catch member 334-2.

Referring to FIGS. 29 and 30, a secondary vent chamber 336 is defined by a void located between end cap 318 and lid 316. Referring to FIGS. 29 and 30, in conjunction with FIGS. 24 and 25, vent path 302 includes a second vent path portion 338 that is in fluid communication with tortuous vent path portion 328 and with secondary vent chamber 336. In particular, second vent path portion 338 of vent path 302 extends from the atmosphere external to microfluidic dispensing device 300 and through gap 330 between end cap 318 and lid 316/body casing 314 to join in fluid communication the tortuous vent path portion 328 and secondary vent chamber 336. Second vent path portion 338 provides multiple venting pathways around the periphery of gap 330, and includes, for example, a cap vent path 338-1 and a cap vent path 338-2 depicted in FIG. 30 at gap 330, so as to complete vent path 302 from primary vent chamber 324 to the atmosphere external to microfluidic dispensing device 300.

In accordance with the present embodiment, advantageously, second vent path portion 338 of vent path 302 is in direct fluid communication with the atmosphere around the periphery of gap 330. Thus, external indicia or components, such as product labeling, may be placed anywhere in the region of gap 330 of microfluidic dispensing device 300, so long as an entirety of the periphery at gap 330, i.e., on all four sides of microfluidic dispensing device 300, is not sealed.

While the invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fluidic dispensing device, comprising:
- a casing having a reservoir chamber and a primary vent chamber;
- an end cap positioned at an end of the casing, the end cap being connected to the casing; and
- a vent path that extends from the primary vent chamber to the atmosphere through a gap between the end cap and the casing.

2. The fluidic dispensing device of claim 1, wherein the casing includes a regulation member associated with the reservoir chamber, a body and a lid attached to the body, the body defining the reservoir chamber, the primary vent chamber located adjacent the regulation member and the lid positioned to cover the regulation member.

3. The fluidic dispensing device of claim 2, wherein the end cap defines a secondary vent chamber between the end cap and at least one of the body and the lid, the secondary vent chamber interposed in the vent path between the primary vent chamber and the atmosphere.

4. The fluidic dispensing device of claim 2, wherein the vent path includes a vent path portion located in a gap between the body and the lid.

5. The fluidic dispensing device of claim 2, wherein the end cap defines a secondary vent chamber between the end cap and at least one of the body and the lid, and wherein the vent path includes:
- a first vent path portion located in the lid to couple the primary vent chamber to the secondary vent chamber; and
- a second vent path portion located in a gap between the end cap and at least one of the body and the lid to couple the secondary vent chamber to the atmosphere.

6. The fluidic dispensing device of claim 2, wherein the end cap is releasably attached to at least one of the body and the lid by a snap latch mechanism.

7. The fluidic dispensing device of claim 2, wherein the vent path includes:
- a first vent path portion in direct fluid communication with the primary vent chamber; and
- a second vent path portion that extends through the gap of the end cap with at least one of the body and the lid to the atmosphere, the second vent path portion being in fluid communication with the first vent path portion.

8. The fluidic dispensing device of claim 1, wherein the regulation member is a diaphragm that is in sealing engagement with a perimetrical end surface of the chamber to cover the reservoir chamber.

9. The fluidic dispensing device of claim 1, wherein the regulation member is a capillary member positioned in the reservoir chamber.

10. A fluidic dispensing device, comprising:
- a body having a reservoir chamber;
- an ejection chip attached to the body in fluid communication with the reservoir chamber;
- a regulation member associated with the reservoir chamber;
- a lid that covers the reservoir chamber and is attached to the body; and
- a vent path including a first vent path portion that extends through a gap between the lid and the body, the vent path being in fluid communication both with the regulation member and with the atmosphere external to the fluidic dispensing device.

11. The fluidic dispensing device of claim 10, further comprising an end cap positioned at an end of the body opposite to the ejection chip, the end cap being attached to at least one of the body and the lid, and wherein the vent path includes a second vent path portion that extends through a gap of the end cap with at least one of the body and the lid to the atmosphere.

12. The fluidic dispensing device of claim 10, further comprising an end cap positioned at an end of the body opposite to the ejection chip, the end cap being releasably attached to at least one of the body and the lid by a snap latch mechanism, and wherein the vent path includes a second vent path portion that extends through a gap of the end cap and at least one of the body and the lid to the atmosphere.

13. The fluidic dispensing device of claim 10, wherein:
- the reservoir chamber has a perimetrical end surface;
- the regulation member is a diaphragm that is in sealing engagement with the perimetrical end surface of the reservoir chamber; and
- the lid covers the diaphragm to form a primary vent chamber between the lid and the diaphragm, the primary vent chamber being in fluid communication with the first vent path portion of the vent path.

14. The fluidic dispensing device of claim 13, further comprising:
- an end cap positioned at an end of the body and the lid opposite to the ejection chip; and
- a secondary vent chamber located between the end cap and at least one of the body and the lid, wherein the vent path includes a second vent path portion that extends through a gap of the end cap with at least one of the body and the lid to the atmosphere, the vent path extending from the primary vent chamber and through the secondary vent chamber to the atmosphere.

15. The fluidic dispensing device of claim 14, wherein the end cap is releasably attached to at least one of the body and the lid by a snap latch mechanism.

16. The fluidic dispensing device of claim 10, further comprising;
- an end cap positioned over the first vent path portion at the gap of the body and the lid;
- a secondary vent chamber between the end cap and at least one of the body and the lid; and the vent path includes a second vent path portion that extends through a gap of the end cap and at least one of the body and the lid to the atmosphere.

17. A fluidic dispensing device, comprising:

a body having an exterior perimeter wall and a reservoir chamber located within a boundary defined by the exterior perimeter wall, the reservoir chamber having a perimetrical end surface;

an ejection chip mounted to the exterior wall, the ejection chip being in fluid communication with the reservoir chamber;

a diaphragm positioned in sealing engagement with the perimetrical end surface of the reservoir chamber, the diaphragm having a dome portion, wherein the dome portion moves along a deflection axis as the fluid is depleted from the fluid reservoir;

a lid engaged with the exterior perimeter wall and attached to the body, the lid positioned to cover the diaphragm to form a dome vent chamber between the lid and the diaphragm;

an end cap positioned on an end of the body and lid opposite to the ejection chip;

a secondary vent chamber located between the end cap and at least one of the body and the lid; and a vent path that extends from the dome vent chamber through the secondary vent chamber to the atmosphere.

18. The fluidic dispensing device of claim 17, wherein the vent path includes a vent path portion located in a gap between the body and the lid.

19. The fluidic dispensing device of claim 17, wherein the vent path includes a vent path portion located in a gap between the end cap and at least one of the body and the lid.

20. The fluidic dispensing device of claim 17, wherein the vent path includes:

a first vent path portion located in a gap between the body and the lid to couple the primary vent chamber to the secondary vent chamber; and a second vent path portion located in a gap between the end cap and at least one of the body and the lid to couple the secondary vent chamber to the atmosphere.

* * * * *